US005600564A

United States Patent [19]

Tarasiewicz et al.

[11] Patent Number: 5,600,564

[45] Date of Patent: Feb. 4, 1997

[54] COKE OVEN BATTERY WITH COMMUNICATION SYSTEM

[75] Inventors: James J. Tarasiewicz, Riverview, Mich.; Edward C. Nichols, Pittsburgh, Pa.

[73] Assignee: National Steel Corporation, Mishawaka, Ind.

[21] Appl. No.: 352,785

[22] Filed: Dec. 1, 1994

[51] Int. Cl.[6] ..... G06F 19/00; B61L 19/02

[52] U.S. Cl. ..... 364/477.05; 246/187 B; 266/143

[58] Field of Search ..... 364/477, 468, 364/426.05, 242.01, 424.02; 202/262; 246/187 B; 266/142, 143, 82, 275, 276, 78, 86

[56] References Cited

U.S. PATENT DOCUMENTS

| | | | |
|---|---|---|---|
| 3,618,794 | 11/1971 | Helm . | |
| 3,624,603 | 11/1971 | Delcomyn | 364/477 |
| 4,053,366 | 10/1977 | Holter | 202/227 |
| 4,072,885 | 2/1978 | Emark, Jr. . | |
| 4,190,498 | 2/1980 | Teschner et al. . | |
| 4,194,686 | 3/1980 | Richter et al. | 235/376 |
| 4,196,471 | 4/1980 | McClure | 364/477 |
| 4,447,805 | 5/1984 | Omae et al. | 340/539 |
| 4,617,638 | 10/1986 | Krause et al. . | |
| 4,674,054 | 6/1987 | Ikeda et al. . | |
| 5,155,681 | 10/1992 | Aoki et al. . | |
| 5,253,846 | 10/1993 | Omae et al. . | |
| 5,314,168 | 5/1994 | Omae et al. . | |

*Primary Examiner*—Roy N. Envall, Jr.
*Assistant Examiner*—Thomas E. Brown
*Attorney, Agent, or Firm*—James L. Bean; Kerkam, Stowell, Kondracki & Clarke, P.C.

[57] ABSTRACT

A coke oven communication and control system uses high frequency spread spectrum transceivers which are land based (connected to a central controller) and machine based (on a charging car, door machine, pusher, or quench car). Each land based transceiver communicates with a single corresponding machine based transceiver, there being different frequencies for each of the machines. Except for the quenching car transceivers, the other land and machine transceivers all are selectively connected to a pair of antennas which are alternately used to overcome interference. An advantageous communication technique is used to send data between a central controller, known as a battery programmable logic controller (PLC), and the machines. Control strategies are used to minimize malfunctioning of the coke oven battery.

20 Claims, 20 Drawing Sheets

FIG. 16
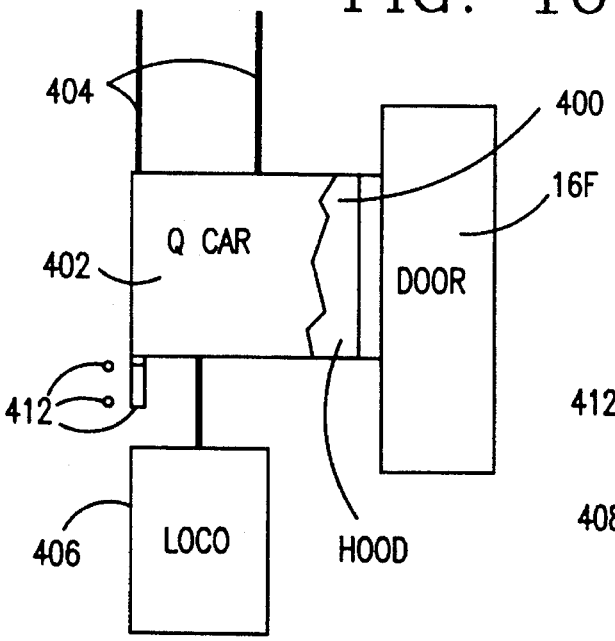
FIG. 17
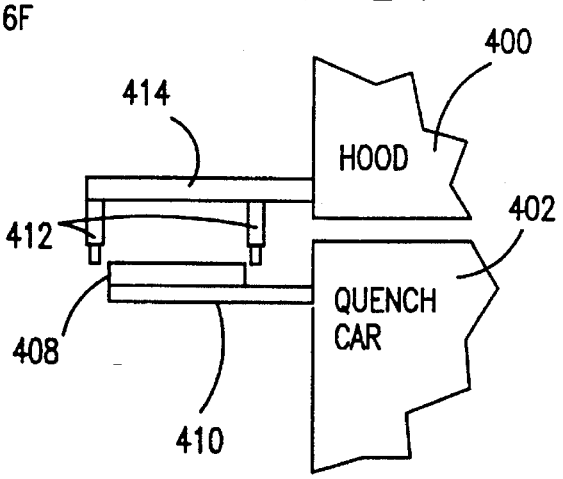
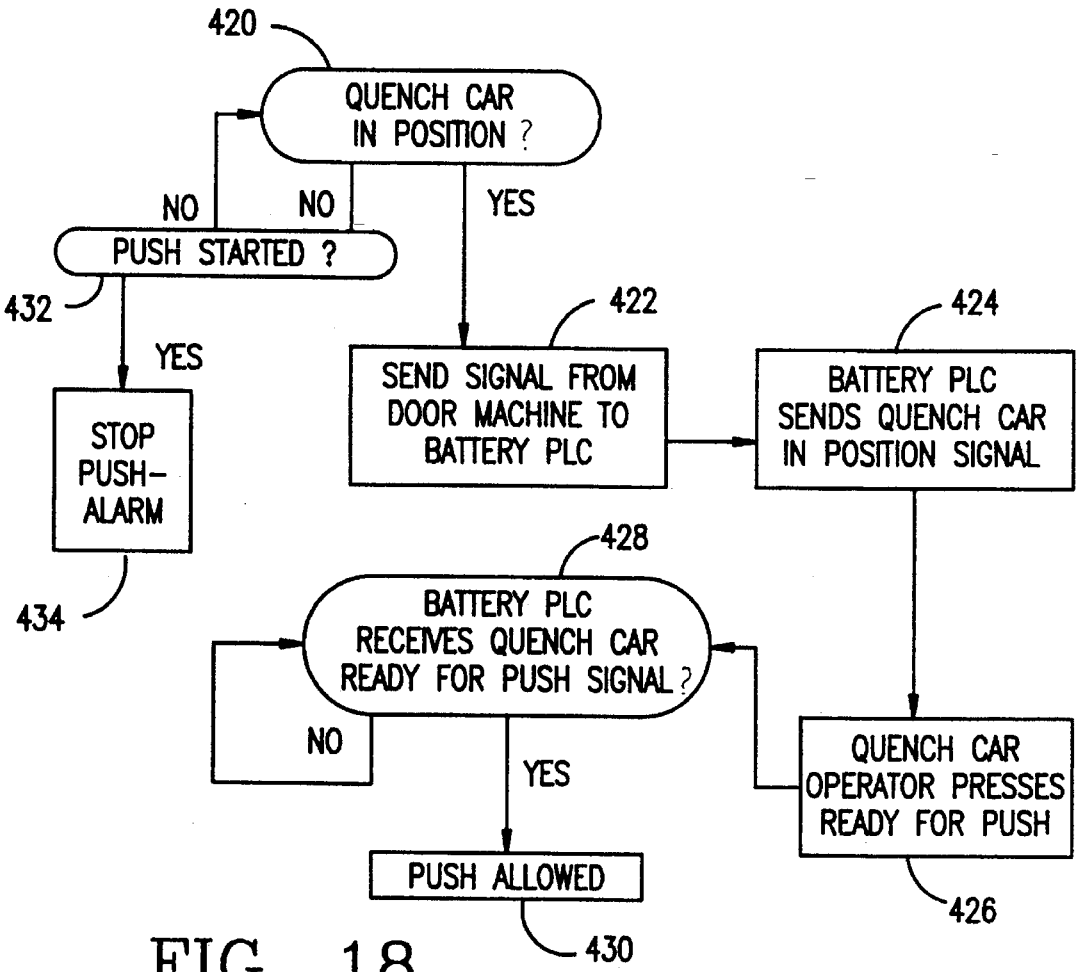
FIG. 18

COKE OVEN BATTERY WITH COMMUNICATION SYSTEM

BACKGROUND OF THE INVENTION

The present invention relates to a coke oven battery. More specifically, this machine relates to such a battery having a control system using radio signals.

A coke oven battery has a plurality of coke ovens with an overhead coal bin for feeding coal into a series of hoppers of the coal charging cars (sometimes called larry cars). The coal charging cars, hereafter referred to as charging cars, in turn deposit coal in the coke ovens. The coal is turned into coke by application of high heat over an extended period of time. After the coal is turned into coke, a door machine opens a door on one side of the coke oven and has guide and hood functions to respectively guide coke into a quench car and capture emissions from the coke exiting the coke oven. Importantly, a pusher is on the side of the coke oven opposite the door machine and functions to push the coke out from the coke oven and into the quench car by way of the guide portion of the door machine. The pusher must not begin pushing until the door machine is properly positioned and has opened the door on the coke oven and performed related functions and the quench car is properly positioned with a positive closure of the bed gate.

The charging cars, door machines, pushers, and quench cars move along the series of coke ovens making up a coke battery. To avoid problems, it is necessary to coordinate the operations of these and possibly other machines which are used in the system.

Among prior patents which have shown various control arrangements for coke oven batteries are the following:

| Inventor | Patent No. |
|---|---|
| Teschner et al | 4,190,498 |
| Ikeda et al | 4,674,054 |
| Omae et al | 5,314,168 |
| Omae et al | 5,253,846 |
| Helm | 3,618,794 |
| Emark, Jr. | 4,072,885 |
| Richter et al | 4,194,686 |
| Krause et al | 4,617,638 |
| Aoki et al | 5,155,681 |

Teschner has coke oven battery machinery position control by radio.

The Ikeda patent shows the use of inductive radio (IR) lines to control pusher machines, charging cars, and other mechanisms in a coke oven. The IR lines are distributed along the paths of the various moving machines. A main controller such as a computer coordinates operations of the mechanisms.

The two Omae patents provide IR for computer control of a quenching car and/or a bucket car.

Helm discloses a coke oven control system using transmitters and receivers (detectors) for gamma rays.

The Emark and Richter patents teach that one can use wireless or cable control signals for coke transfer hot cars and similar machines.

Krause shows temperature sensing using computers and radio in a coke oven.

Aoki has an antenna for providing stop control in a coke oven mechanism.

Although the above and other systems have been generally useful, they have been subject to one or more of several disadvantages.

Generally, such systems have had reliability problems. Specifically, a coke oven battery is a very harsh environment due to heat, dust, gases, movement of large metal structures, and high electromagnetic noise. The environmental factors may quickly degrade various types of control systems and/or prevent reliable operation even when the system is new. For example, stray electromagnetic noise and metal structures (moving and stationary) may cause severe interference with those control systems operating by radio. Indeed, communication of control or data signals between a main controller and a machine may become impossible if the path between them is blocked by a metal machine.

In order to minimize problems from electromagnetic noise and metal structures, various of the radio control arrangements may use inductive radio (IR) communication. Such communication may improve reliability, but it disadvantageously requires one to put a radio inductive link along all or much of a machine's travel path. For example, a charging car having such a system would require a radio inductive link extending adjacent to a corresponding link in the charging car and having a length equal to the travel range of the charging car in order to establish communications all along the travel path of the charging car. Such a radio inductive link may have problems if made too long. Moreover, it is difficult and expensive to have such a radio link built in along the travel path of the machine. To the extent that one limits the inductive links to specific locations along the travel path, this means that the machine such as a charging car often can communicate with the main controller (also called land based since it doesn't move) only at certain locations along its travel path.

Regardless of the type of control system, very high reliability is becoming increasingly important in light of possible excess air pollution and associated heavy government fines. That is, a single malfunction out of 100,000 communications may seem like a high degree of reliability, but may still not be sufficient to avoid problems with air pollution, production losses, damage to equipment, etc.

Those systems which use radio communications may further encounter problems if a mobile radio on a delivery truck or other vehicle starts transmitting while close to the plant. This may be sufficient to knock out communications and, thus, control of the system.

A further problem with many coke battery control systems is that they don't respond well to temporary problems. That is, a momentary failure of communication may cause the system to shut down or otherwise take drastic action instead of more simple remedial action.

OBJECTS AND SUMMARY OF THE INVENTION

Accordingly, it is a primary object of the present invention to provide a new and improved communication system for a coke battery oven.

A more specific object of the present invention is to provide a highly reliable communication system for a coke battery oven.

A further object of the present invention is to provide communication system for a coke battery oven which can work using radio signals, but without the need for inductive radio links.

Yet another object of the present invention is to provide a communication system for a coke battery oven which may respond well and automatically overcome most, if not all, temporary disruptions in communication.

A further object of the present invention is to provide communication system for a coke battery oven which minimizes errors, which errors might otherwise cause air pollution problems.

Yet another object of the present invention is to provide a communication system for a coke battery oven which avoids problems from radio paths being blocked.

Yet another object of the present invention is to provide a communication system for a coke battery oven which avoids or minimizes the various problems discussed above.

The above and other features of the present invention which will be more readily understood when the following detailed description is considered in conjunction with the accompanying drawings are realized by a coke oven battery including: a plurality of coke ovens; a first set of machines associated with the plurality of coke ovens and having at least two machines selected from the group consisting of charging cars, pusher machines, and door machines; a battery controller for controlling the first set of machines and the plurality of coke ovens; a first set of radio land transceiver units operably connected to the battery controller, each land transceiver unit associated on a one-to-one basis with a corresponding one of the first set of machines; and a first set of radio machine transceiver units, each machine transceiver unit mounted for movement with a corresponding one of the first set of machines and operable to communicate with a corresponding land transceiver unit. Each of the land transceiver units and each of the machine transceiver units are spread spectrum transceivers. The first set of machines includes at least one charging car, at least one pusher machine, and at least one door machine. The first set of machines includes at least two charging cars, at least two pusher machines, and at least two door machines.

The coke oven battery further includes a first set of pairs of machine antennas, each pair operably connected to a corresponding one of the first set of machine transceiver units; a plurality of machine signal threshold detectors, one for each pair of the first set of pairs of machine antennas and operable to output a change signal when signal strength is inadequate; a plurality of machine switches, one for each pair of the first set of pairs of machine antennas and operable to switch one of the machine transceiver units from using one antenna to using another antenna upon receipt of a change signal; and wherein each machine transceiver unit has a pair of antennas selectively switchable thereto for use of one at a time.

The coke oven battery further includes a first set of pairs of land antennas, each pair operably connected to a corresponding one of the first set of land transceiver units; a plurality of land signal threshold detectors, one for each pair of the first set of pairs of land antennas and operable to output a change signal when signal strength is inadequate; a plurality of land switches, one for each pair of the first set of pairs of land antennas and operable to switch one of the land transceiver units from using one antenna to using another antenna upon receipt of a change signal.

The coke oven battery further includes a first set of pairs of machine antennas, each pair operably connected to a corresponding one of the first set of machine transceiver units; a plurality of machine spread code threshold detectors, one for each pair of the first set of pairs of machine antennas and operable to output a change signal when a received spread code from a land transceiver unit is invalid; a plurality of machine switches, one for each pair of the first set of pairs of machine antennas and operable to switch one of the machine transceiver units from using one antenna to using another antenna upon receipt of a change signal; and wherein each machine transceiver unit has a pair of antennas selectively switchable thereto for use of one at a time.

The coke oven battery further includes a first set of pairs of land antennas, each pair operably connected to a corresponding one of the first set of land transceiver units; a plurality of land spread code threshold detectors, one for each pair of the first set of pairs of land antennas and operable to output a change signal when a spread code received from one of the land transceiver units is invalid; a plurality of land switches, one for each pair of the first set of pairs of land antennas and operable to switch one of the land transceiver units from using one antenna to using another antenna upon receipt of a change signal.

Each pair of machine antennas is coated with a rubber-based protective coating. The first set of machines includes a pusher and a door machine. The coke oven battery further includes: means for an operator to input a pusher oven number corresponding to an oven number at which the pusher is disposed at; means to receive the pusher oven number; means for an operator to input a door machine oven number corresponding to an oven number at which the door machine is disposed at; means to receive the door machine oven number; means to compare the pusher oven number and the door machine oven number; and means to enable oven door removal upon the pusher oven number and the door machine oven number being equal.

The first set of machines includes a charge car and a pusher having a leveler offset from a main part thereof, and the battery further includes: means for an operator to input a charge oven number corresponding to an oven number at which charging is desired; means to receive the charge oven number; means for an operator to input a pusher oven number corresponding to an oven number at which the pusher is disposed at; means to receive the pusher oven number; and means to prevent charging unless the charging oven number and pusher oven number have a difference corresponding to an offset between a leveler and compare the pusher oven number and the door machine oven number.

The battery controller is operable to cause each land transceiver unit to send a given communication to the corresponding machine transceiver unit, test for successful transmission, resend the given communication n times if transmission is not yet successful, initiate a read of machine data if transmission is unsuccessful within n attempts, test for successful read, try reading again m times if reading is not yet successful again, and initiate an alarm condition if reading is unsuccessful after m attempts; and wherein communication between the land transceiver units and the machine transceiver units is at least 99% reliable.

The invention may alternately be described as a coke oven battery including: a plurality of coke ovens; a first set of machines associated with the plurality of coke ovens and having at least two machines selected from the group consisting of charging cars, pusher machines, and door machines; a battery controller for controlling the first set of machines and the plurality of coke ovens; a first set of radio land transceiver units operably connected to the battery controller, each land transceiver unit associated on a one-to-one basis with a corresponding one of the first set of machines; and a first set of radio machine transceiver units, each machine transceiver unit mounted for movement with a corresponding one of the first set of machines and operable to communicate with a corresponding land transceiver unit; and further including a first set of pairs of machine antennas, each pair operably connected to a corresponding one of the first set of machine transceiver units; a plurality of machine signal threshold detectors, one for each pair of the first set of pairs of machine antennas and operable to output a change signal when signal strength is inadequate; a plurality of machine switches, one for each pair of the first set of pairs of machine antennas and operable to switch one of the machine transceiver units from using one antenna to using another antenna upon receipt of a change signal; and wherein each machine transceiver unit has a pair of antennas selectively switchable thereto for use of one at a time.

The coke oven battery further includes a first set of pairs of land antennas, each pair operably connected to a corresponding one of the first set of land transceiver units; a plurality of land signal threshold detectors, one for each pair of the first set of pairs of land antennas and operable to output a change signal when signal strength is inadequate; a plurality of land switches, one for each pair of the first set of pairs of land antennas and operable to switch one of the land transceiver units from using one antenna to using another antenna upon receipt of a change signal.

The coke oven battery has first and second ends, and wherein the first set of machines includes a first charging car, a first pusher machine, and a first door machine associated with the first end and includes second charging car, a second pusher machine, and a second door machine associated with the second end; and wherein land antennas associated with the first charging car, the first pusher machine, and the first door machine are at the first end and wherein land antennas associated with the second charging car, the second pusher machine, and the second door machine are at the second end.

The invention may alternately be described as a coke oven battery including: a plurality of coke ovens; a first set of machines associated with the plurality of coke ovens and having at least two machines selected from the group consisting of charging cars, pusher machines, and door machines; a battery controller for controlling the first set of machines and the plurality of coke ovens; a first set of radio land transceiver units operably connected to the battery controller, each land transceiver unit associated on a one-to-one basis with a corresponding one of the first set of machines; and a first set of radio machine transceiver units, each machine transceiver unit mounted for movement with a corresponding one of the first set of machines and operable to communicate with a corresponding land transceiver unit; and wherein the battery controller is operable to cause each land transceiver unit to send a given communication to the corresponding machine transceiver unit, test for successful transmission, resend the given communication n times if transmission is not yet successful, initiate a read of machine data if transmission is unsuccessful within n attempts, test for successful read, and try reading again m times if reading is not yet successful again. Preferably, n equals 3 and m equals 3.

BRIEF DESCRIPTION OF THE DRAWINGS

The above and other features of the present invention will be more readily understood when the following detailed description is considered in conjunction with the accompanying drawings wherein like characters represent like parts throughout the several views and in which:

FIG. 3, composed of left and right portions

FIG. 4, composed of left and right portions

FIG. 5, composed of left and right portions

FIG. 16 is a top view of a door machine and related components;

FIG. 17 is a detailed view corresponding to part of FIG. 16; and

FIG. 18 is a simplified flow chart relative to a control strategy.

DETAILED DESCRIPTION

Figure 1:
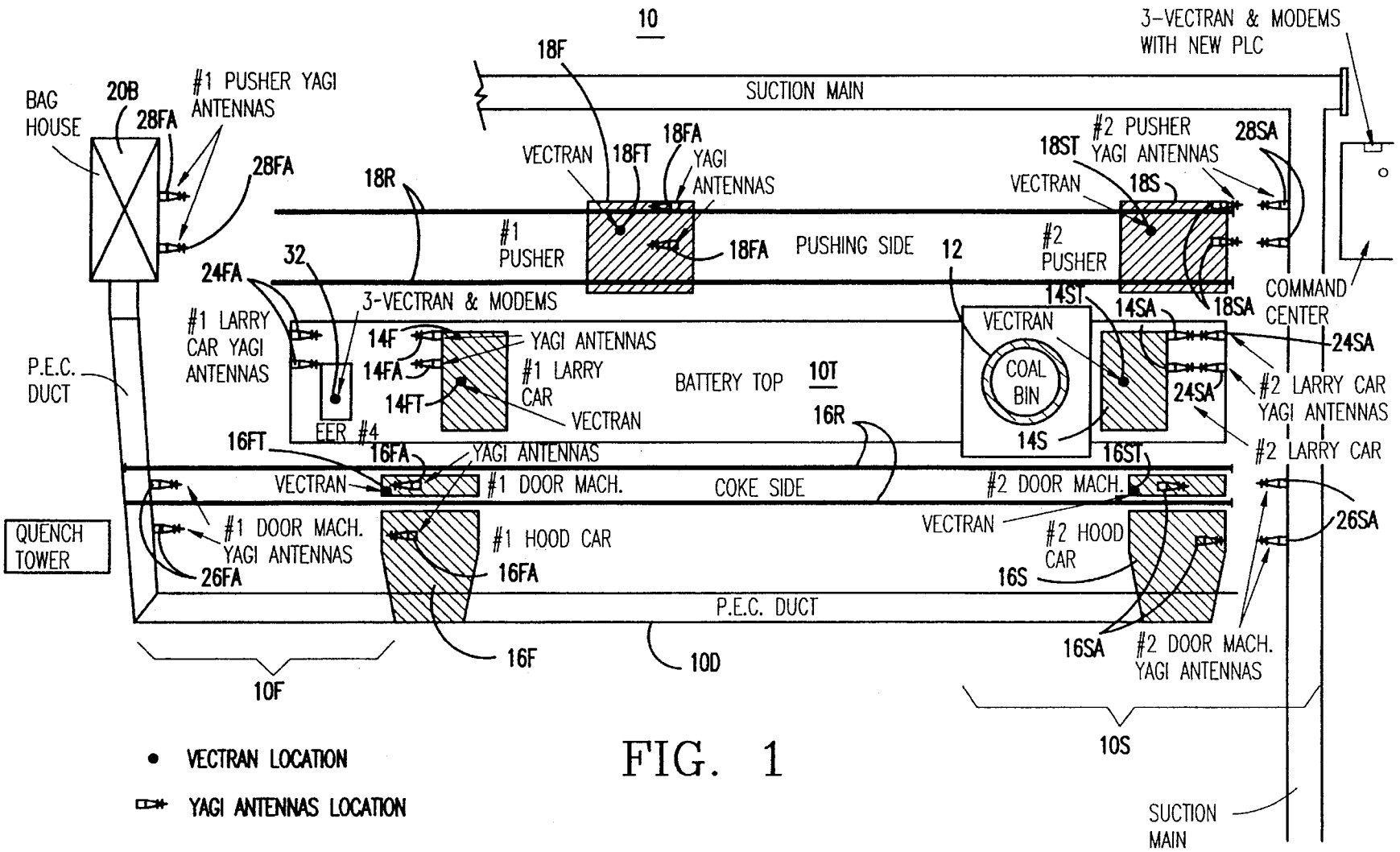
FIG. 1 is a simplified top view of a coke oven battery according to the present invention.
Figure 2A:
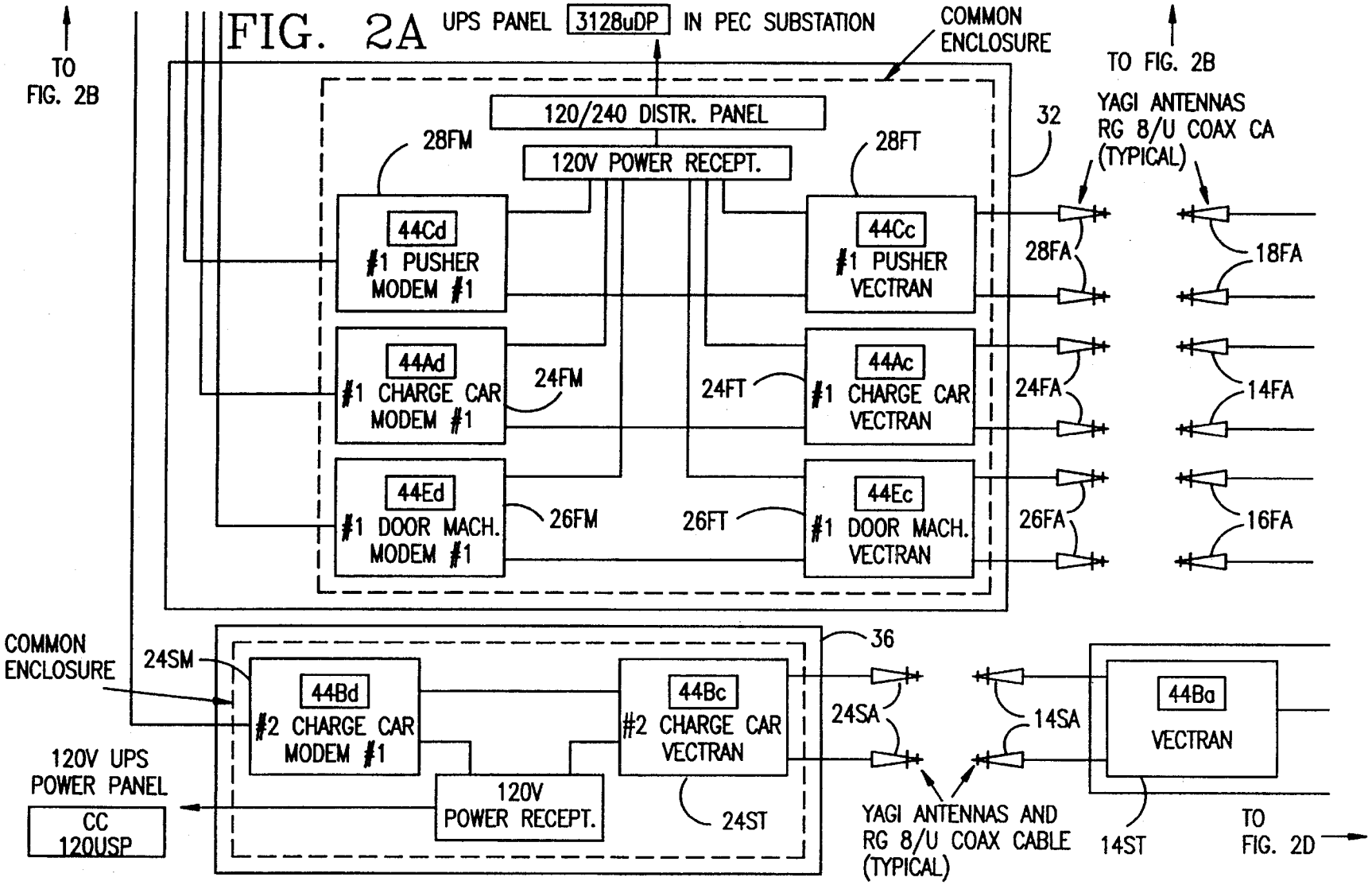
FIGS. 2A, 2B, 2C, and 2D, which fit together respectively in the lower left, upper left, upper right, and lower right, which will be collectively referred to as FIG. 2, show a simplified block diagram of the communication/control system of the present invention.
Figure 2B:
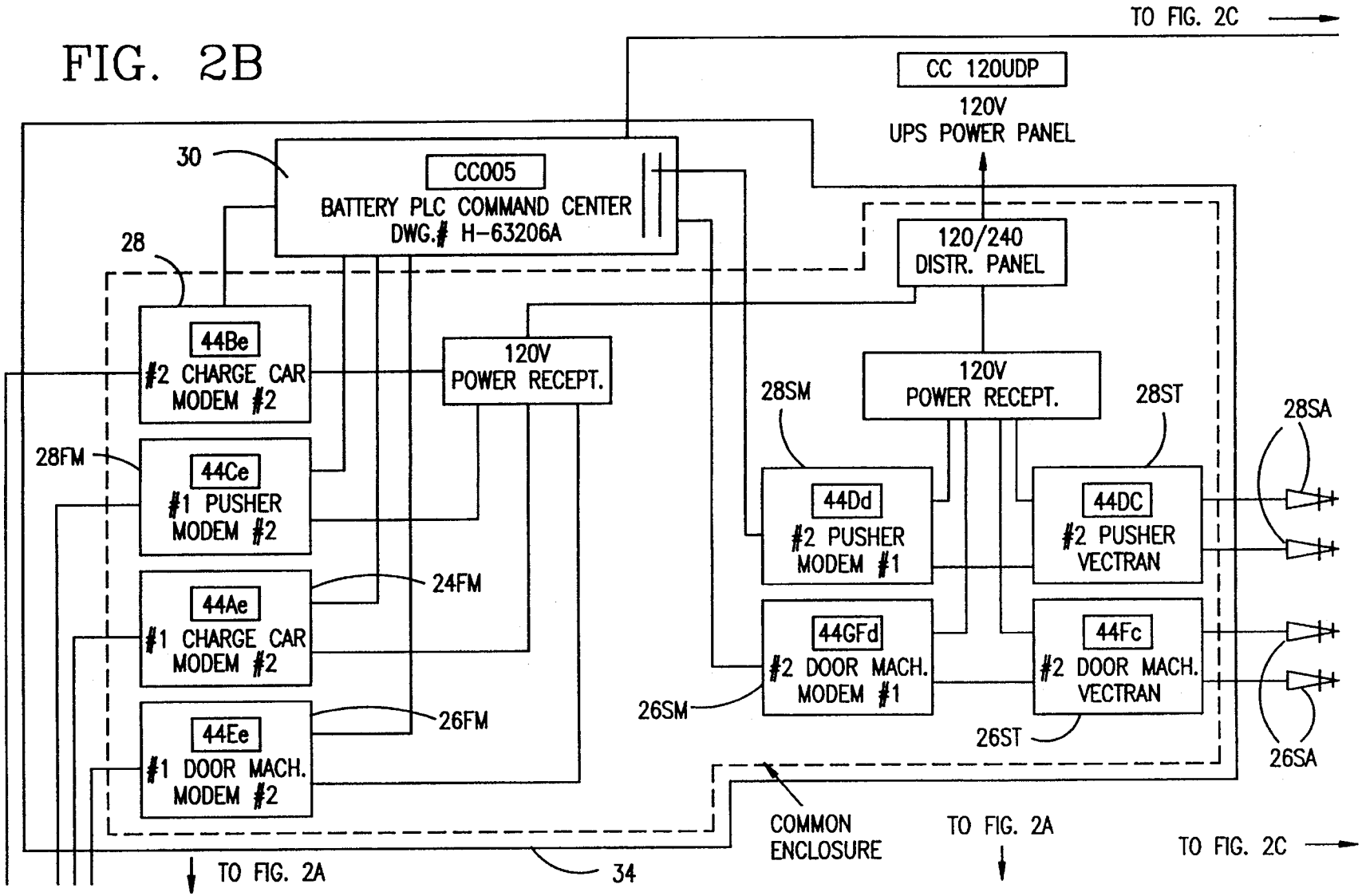
Figure 2C:
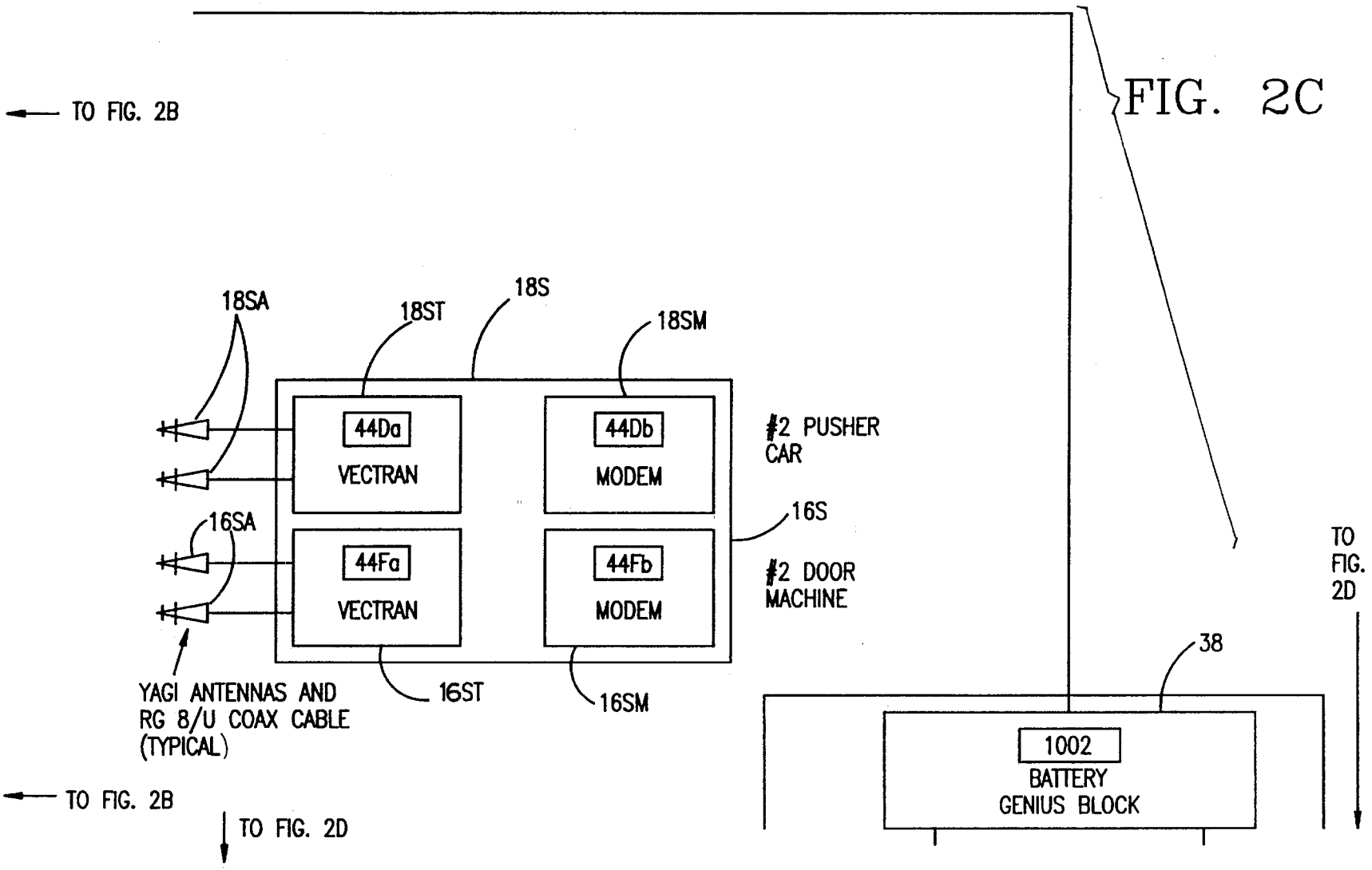
Figure 2D:
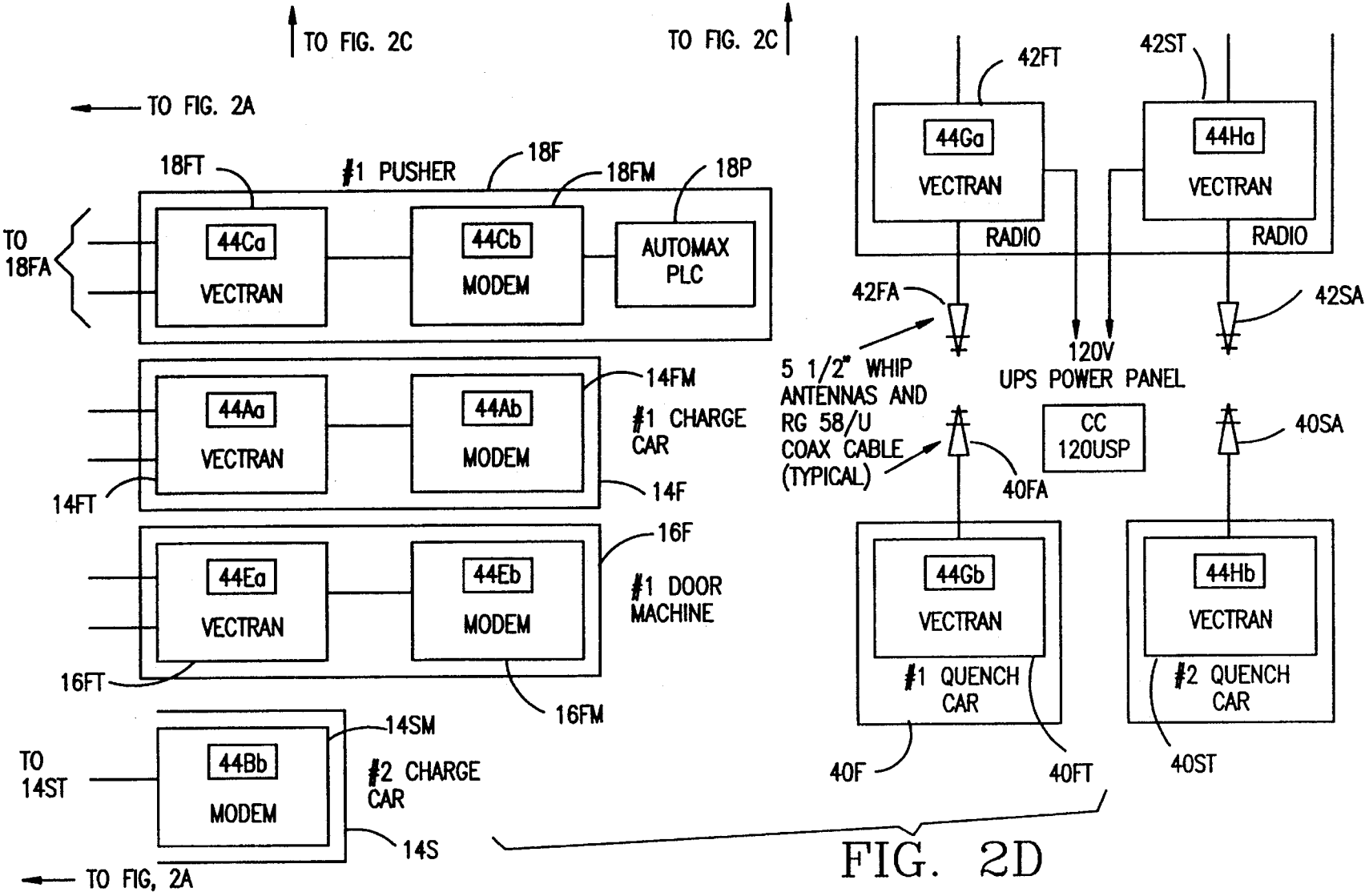

Initially with reference to FIG. 1, the coke oven battery 10 includes a plurality of coke ovens (not individually shown) under the battery top 10T. A coal bin 12 is disposed above battery top 10T and is used for filling first and second coal charging cars 14F and 14S respectively associated with the first and second ends 10F and 10S of the battery 10. The coal charging cars 14F and 14S, also called charging cars or larry cars, are used to load coal into the ovens of battery 10 in generally known fashion.

The coal is processed into coke for use as fuel in heating metals for various manufacturing processes. The coal is heated in the ovens of battery 10 to turn it into coke in a well known fashion. First and second door machines 16F and 16S include hood cars as part thereof and are respectively associated with the first and second ends 10F and 10S, but are movable along rails 16R for positioning on the coke side of different ones of the ovens in battery 10. First and second pusher machines 18F and 18S are respectively associated with the first and second ends 10F and 10S, but are movable along rails 18R for positioning on the coke side of different ones of the ovens in battery 10. The overall operation of the pusher machines and door machines is relatively standard with the door machines opening up a coke side door and one of the pusher machines pushing the coke out the coke side door into a quench car. Fumes from the exiting coke go into the pushing emissions control (P.E.C.) duct 20D for passage to baghouse filter equipment 20B. Since these components and overall operations are relatively standard, the discussion which follows will emphasize other aspects of the present system.

Each of the machines 14F, 14S, 16S, 18F, and 18S has a corresponding machine transceiver unit 14FT, 14ST, 16FT, 16ST, 18FT, and 18ST respectively and which receive and transmit signals by way of connected corresponding pairs of antennas 14FA, 14SA, 16FA, 16SA, 18FA, and 18SA. The operation of the dual or pairs of antennas which be described in more detail below since these arrangement is a highly advantageous feature of the present invention. Each of the machines 14F, 14S, 16S, 18F, and 18S has a corresponding land transceiver unit 24FT, 24ST, 26FT, 26ST, 28FT, and 28ST (not specifically shown in FIG. 1) connected to corresponding pairs of land antennas 24FA, 24SA, 26FA, 26SA, 28FA, and 28SA. The land transceivers and land antennas are unlike the machine transceivers since they are not mounted to the moving machines, but are connected to a master programming logic controller (PLC) (not shown in FIG. 1) discussed below. Basically, the PLC controls the various machines 14F, 14S, 16S, 18F, and 18S as discussed in detail below. FIG. 1 and some of the other figures may refer to Vectran, which is a preferred specific brand of radio transceivers. The antennas may be highly directional high gain Yagi type antennas as noted.

An important feature of the present invention is the illustrated positioning of the antennas of FIG. 1. The antennas 24FA, 26FA, and 28FA are at the first end 10F of battery 10, whereas the antennas 24SA, 26SA, and 28SA are at the second end 10S of battery 10. Thus, the land or non-movable antennas are more likely to have an unobstructed path to the corresponding antennas on the corresponding moving machines than if all land antennas were at one end of the battery 10. More specifically, each of the land antennas points to (i.e., its line or central axis of highest gain) and is in line (a line parallel to the direction of movement corresponding with rails 16R and 18R) with a corresponding machine antenna and the machine antenna is in turn in line with and points to a corresponding land antenna. For example, each of the antennas 14FA is in line with a corresponding one of the antennas 24FA, the line being parallel to the direction of movement of the charging car 14F such that communication is facilitated no matter where the car 14F is in its path of movement. This in line feature is true for each land antenna and its corresponding machine antenna.

With reference now to FIG. 2, composed of FIGS. 2A, 2B, 2C, and 2D combined, the communication and control structure of the present invention will be described. Although various power panels, receptacles, and the like are shown in FIG. 2, they are standard and need not be discussed in detail. First charge car 14F has Vectran transceiver unit 14FT connected to modem 14FM and antenna pair 14FA, whereas second charge car 14S has Vectran transceiver unit 14ST connected to modem 14SM and antenna pair 14SA. First door machine 16F has Vectran transceiver unit 16FT connected to modem 16FM and antenna pair 16FA, whereas second door machine 16S has Vectran transceiver unit 16ST connected to modem 16SM and antenna pair 16SA. First pusher 18F has Vectran transceiver unit 18FT connected to modem 18FM and antenna pair 18FA, whereas second pusher 18S has Vectran transceiver unit 18ST connected to modem 18SM and antenna pair 18SA. Although only shown for first pusher 18F for ease of illustration, each of the modems discussed for the various machines will be connected to a programmable logic controller (PLC) such as Automax 18P. The PLC for each of the charging cars, pushers, and door machines controls operation of the particular machine. The PLC from each such machine is in communication with a battery command center PLC 30 by way of corresponding antennas 24FA, 24SA, 26FA, 26SA, 28FA, and 28SA, transceivers 24FT, 24ST, 26FT, 26ST, 28FT, and 28ST, and modems 24FM, 24SM, 26FM, 26SM, 28FM, and 28SM.

Land transceivers 24FT, 26FT, and 28FT and one each of corresponding modems 24FM, 26FM, and 28FM are in a common enclosure or housing 32, which is mounted at first end 10F of battery 10 (refer back momentarily to FIG. 1). The modems 24FM, 26FM, and 28FM within housing 32 are connected by cables respectively to other modems 24FM, 26FM, and 28FM within a command housing or enclosure 34. The enclosure or housing 36 has transceiver 24ST and one modem 24SM disposed therein, which modem connects to command PLC 30 by way of another modem 24SM within enclosure 34.

The pairs of modems 24FM, 24SM, 26FM, and 28FM are used since the command PLC 30 is offset some distance from the corresponding transceiver units. In contrast, land door antennas 26SA are connected to PLC 30 by way of transceiver 26ST and a single modem 26SM since there is much less offset. Likewise, land pusher antennas 28SA connect to PLC 30 by way of transceiver 28ST and a single modem 28SM.

The connections of antennas 16SA and 18SA, transceivers 16ST and 18ST, and modems 16SM and 18SM are as shown except that machine PLCs such as 18P are not shown for ease of illustration.

Figure 3A:
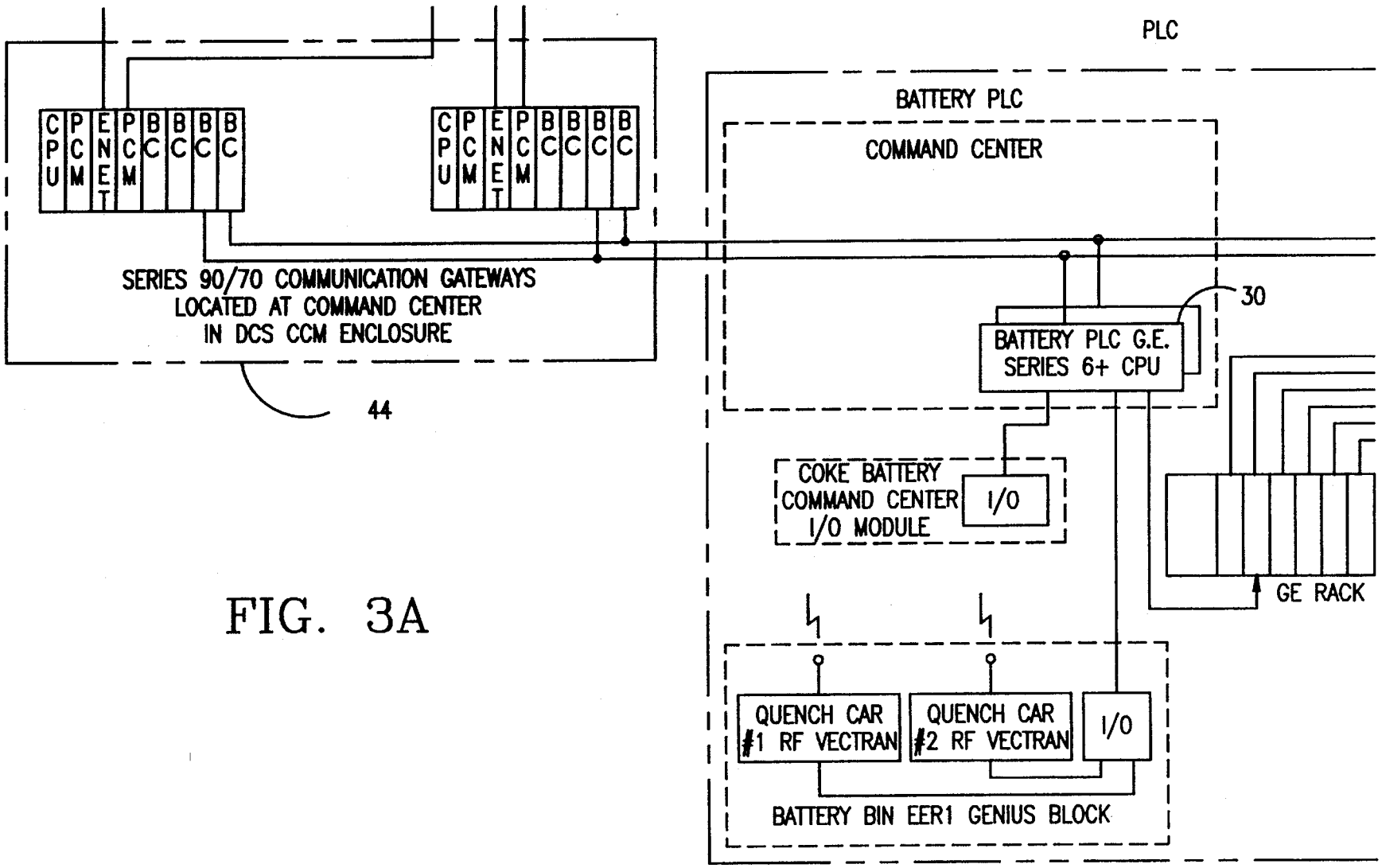
FIGS. 3A and 3B, is a block diagram showing command PLC 30 and various associated components.
Figure 3B:
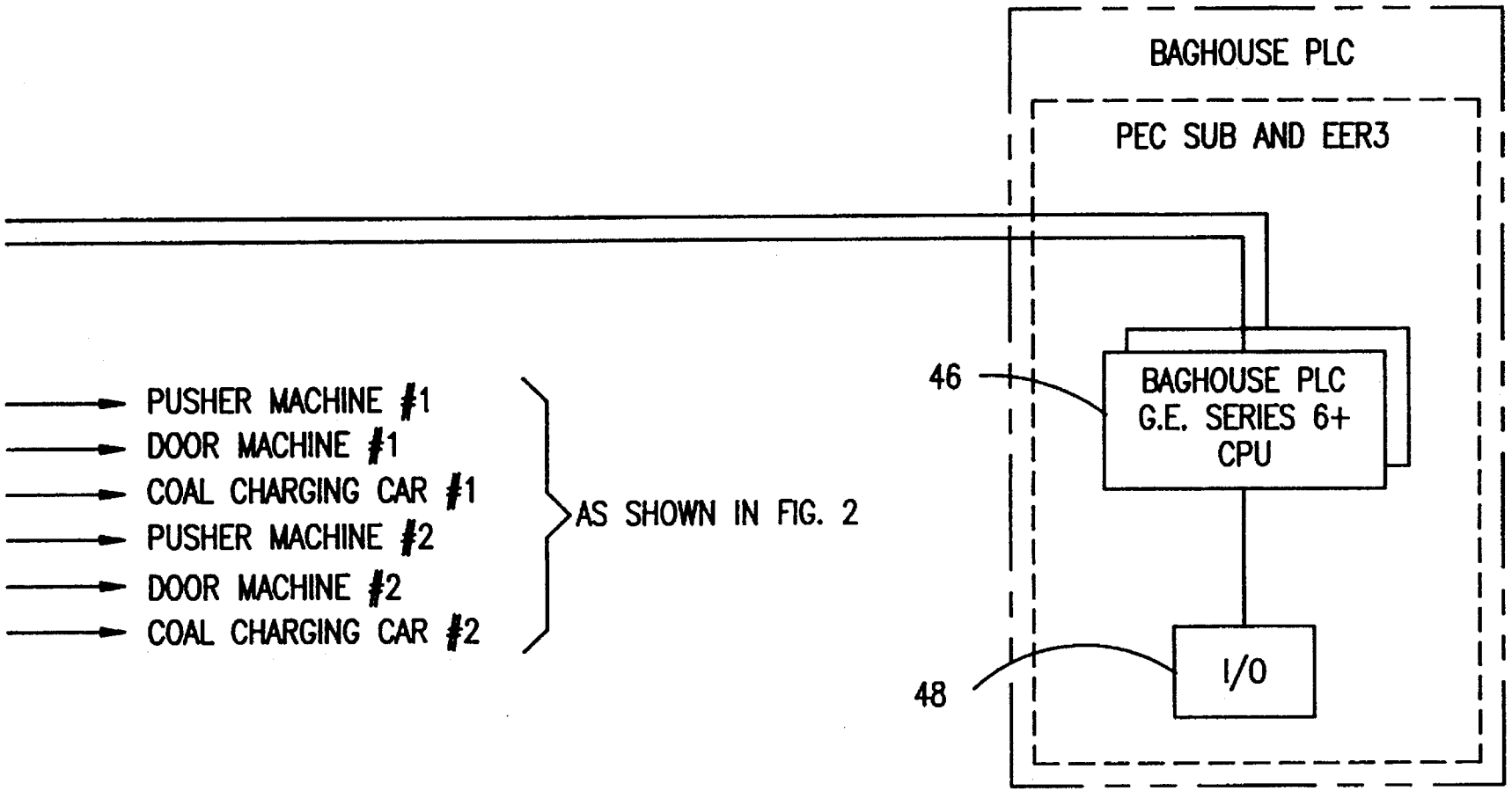
Figure 4A:
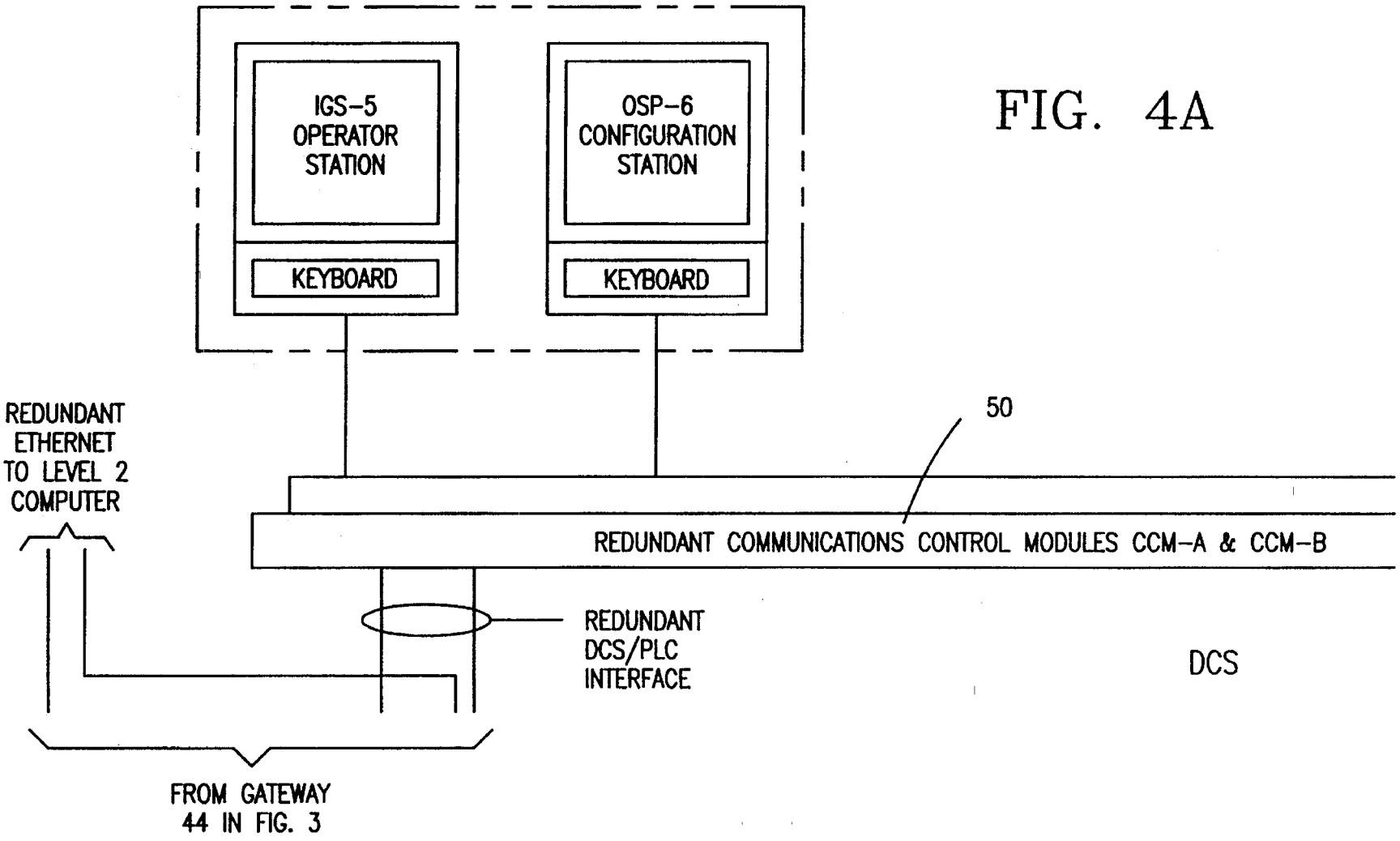
FIGS. 4A and 4B, is a block diagram showing various components used by operators to interface with the FIG. 3 components.
Figure 4B:
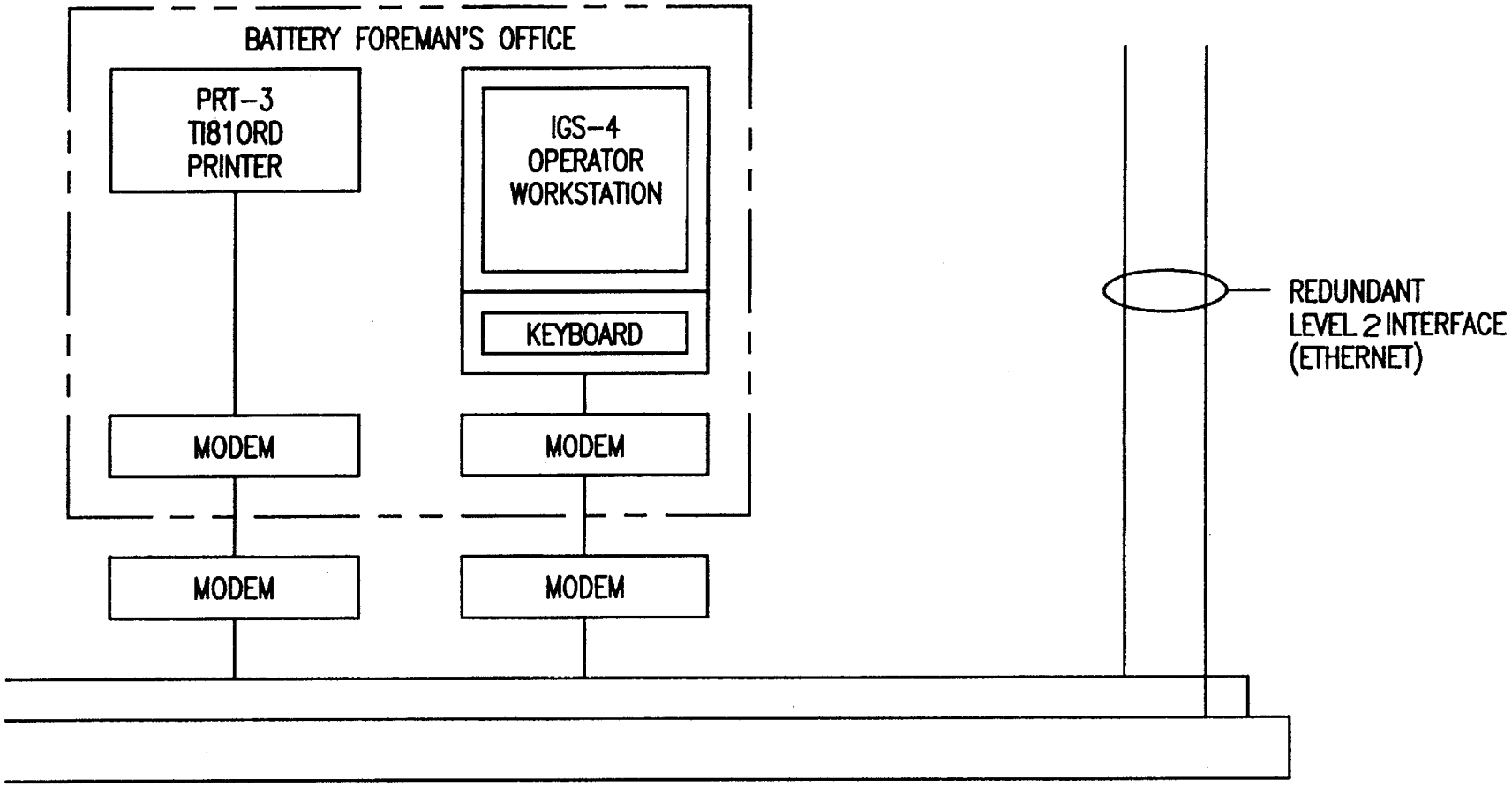
Figure 5A:
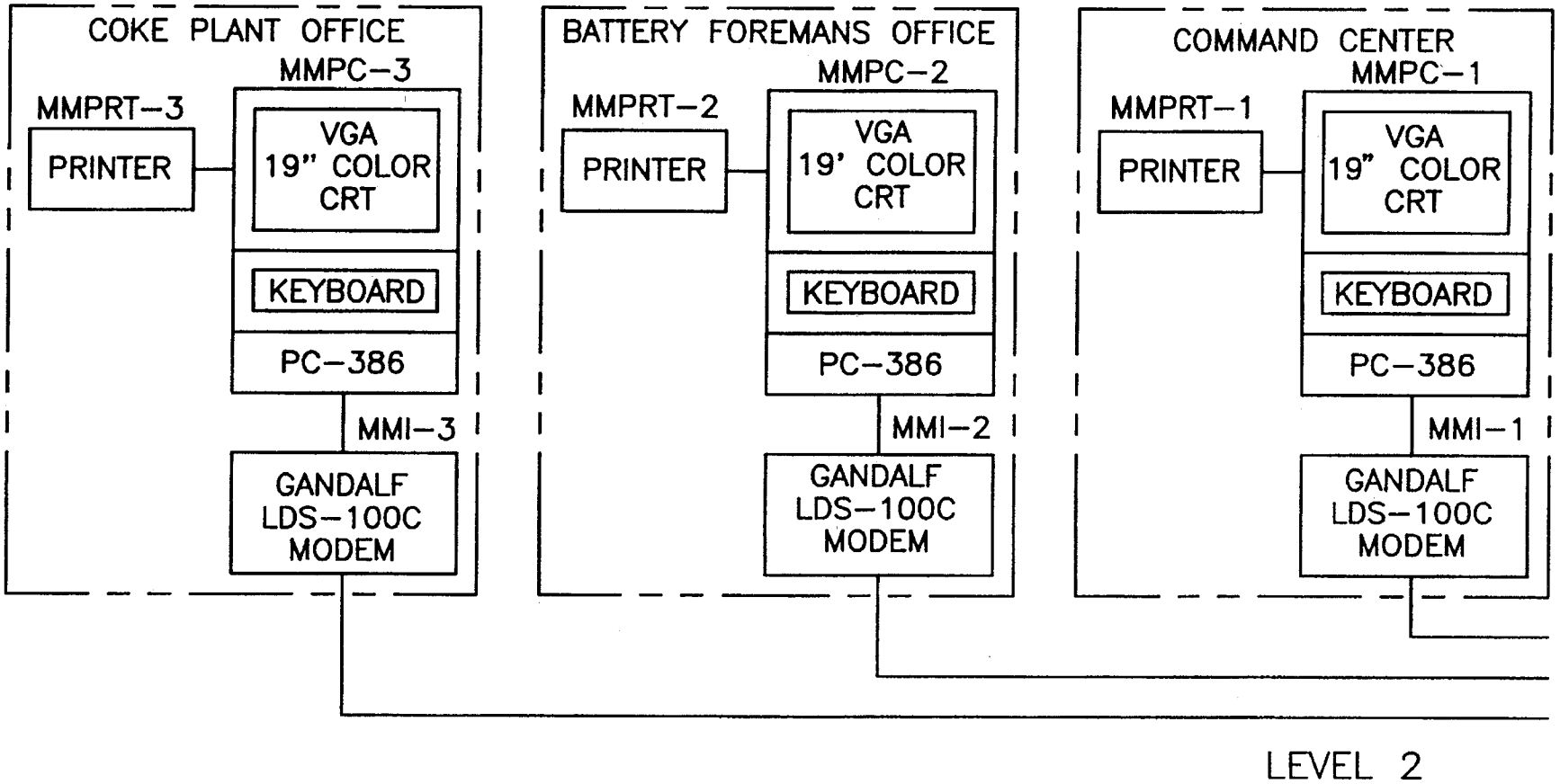
FIGS. 5A and 5B, is a block diagram showing various components at a higher control level (level 2) than that of FIG. 4.
Figure 5B:
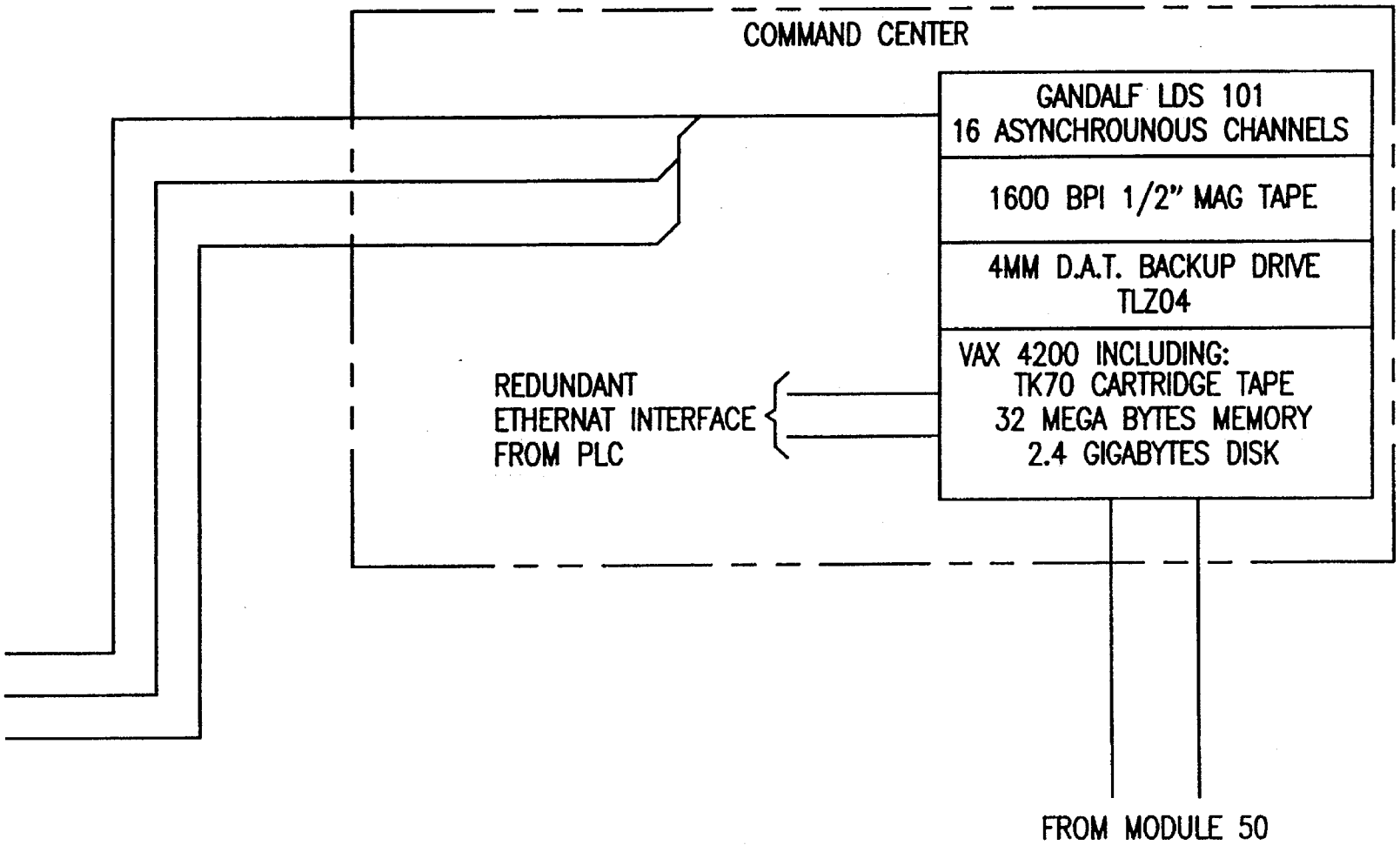

Command PLC 30 is connected to a battery Genius (a known input/output interface made by General Electric) block 38 which controls first and second quench cars 40F and 40S having transceivers 40FT and 40ST and antennas 40FA and 40SA. Although not shown, modems could be used in the quench cars. However, the transceivers 40FT and 40ST may operate in full duplex without the need for modems. The transceivers 40FT and 40ST communicate with the genius block 38 by way of land antennas 42FA and 42SA and transceivers 42FT and 42ST. The antennas for these transceivers are not arranged with a pair for each transceiver as was the case for the other machines. These transceivers used for quench car operation may be operated at frequencies between 450 and 460 MHz for example, whereas the frequencies used for the charging cars, pushers, and door machines would be above 900 MHz. FIG. 3 shows that the command PLC 30 is connected to a gateway arrangement 44 and to baghouse PLC 46 having input/output block 48. The gateway 44 connects to a communications control module 50 shown in FIG. 4, which module has the illustrated components connected thereto for monitoring and control purposes. In turn, module 50 is connected to the level 2 computer and monitoring components of FIG. 5 which allow overall control of the battery 10.

Figure 6:
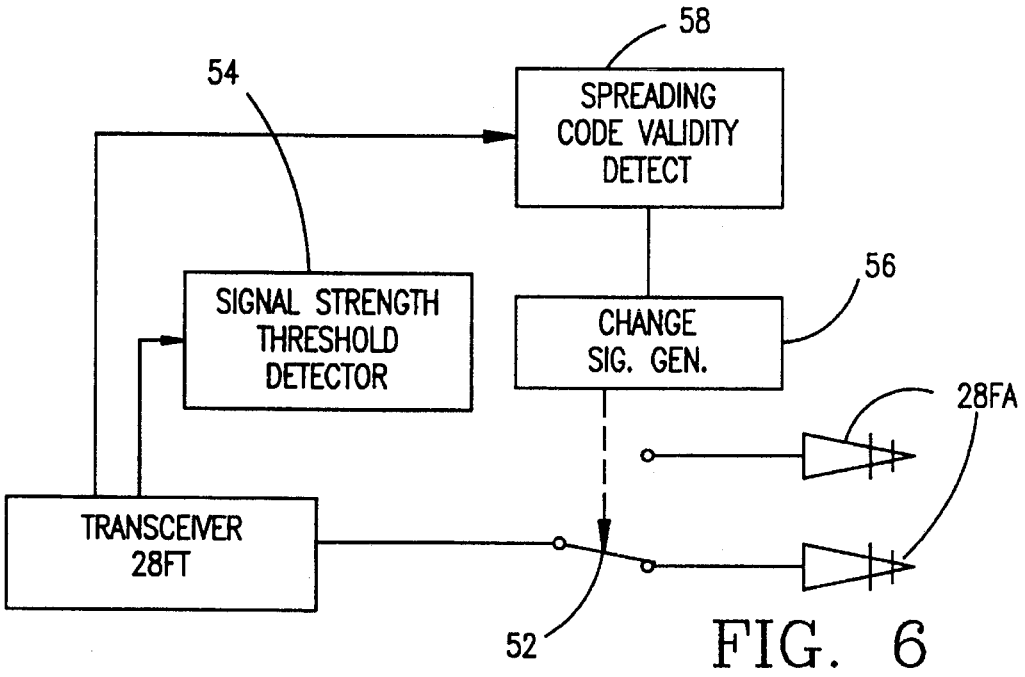
FIG. 6 is a block diagram showing the arrangement used to connect pairs of antennas to the transceivers.

FIG. 6 shows the manner in which pairs of antennas such as 28FA are connected to their corresponding transceiver such as 28FT. It will be understood that all of the land based and machine transceivers of FIG. 2 which have antenna pairs will use this same system of connection. A controlled switch 52 selectively connects only one of the antennas 28FA at a time. A signal strength threshold detector 54 checks if the signal strength is above a threshold. If not, detector 54 sends a signal to change signal generator 56 to cause it to generate a change signal which in turn controls switch 52. Specifically, the change signal causes it to switch the antenna connected to the transceiver 28FT.

The transceivers such as 28FT are half duplex spread spectrum transceivers which send a spread code and send data in digital form, preferably at a frequency above 900 MHz, each pair of communicating or corresponding land and machine transceivers (refer back momentarily to FIG. 2) communicating on non-overlapping frequencies from the other corresponding pairs. (The land and machine transceivers associated with the quench cars are full duplex and do not use a pair of antennas.) As shown in FIG. 6, a spread code tester 58 checks for the validity of a received spread code. If not valid, the tester or validity detector 58 is connected to the change signal generator to cause it to generate a change signal to switch 52 for the purpose of changing antennas.

Although blocks 54, 56, and 58 are shown as hardware elements, it will be readily understood that this technique may alternately be implemented using software to check signal strength, spread code validity, and control which antenna 28FA is switched to connection with the transceiver. Regardless of whether this feature is implemented using hardware or software, it helps maintain reliability of communication. Specifically, if one of antennas 28FA is not receiving properly due to positioning, interference from a metallic or other structure, or stray electromagnetic noise, the other antenna will be switched into operation and will likely avoid or overcome the problem.

Figure 7:
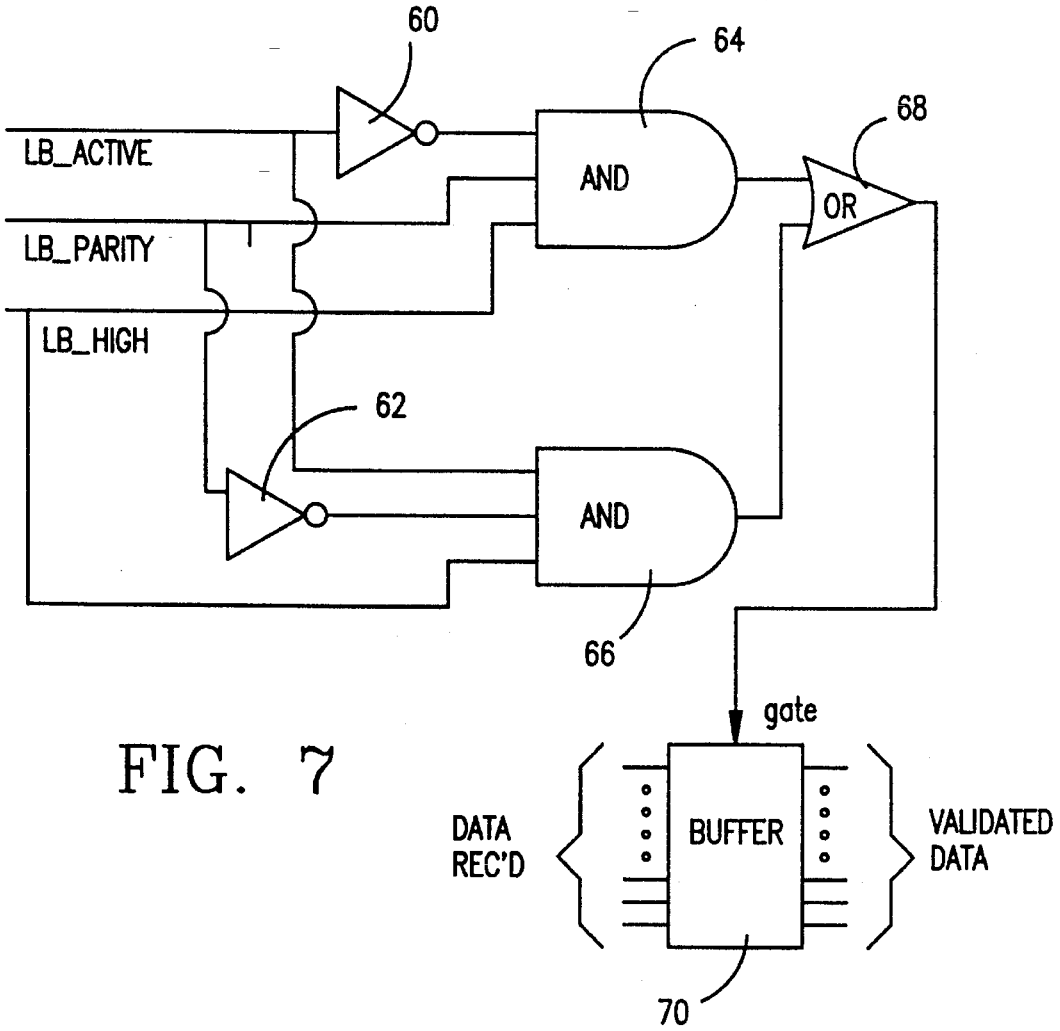
FIG. 7 is an illustration of a parity check procedure used by the present system.

FIG. 7 demonstrates a parity check used for the digital data transmitted by the various transceivers such as 28FT. Again, the other transceivers, both land based and machine, would work the same way. Transmitted data includes LB_ACTIVE, LB_PARITY, and LB_HIGH are fed to not gates (inverters) 60 and 62, AND gates 64 and 66, and OR gate 68 in the illustrated manner to validate the remaining data fed to buffer 70 only if LB_HIGH is true (logical one or high) and LB_ACTIVE and LB_PARITY have opposite states. Again, the technique of FIG. 7 may be implemented using software instead of hardware.

Figure 8:
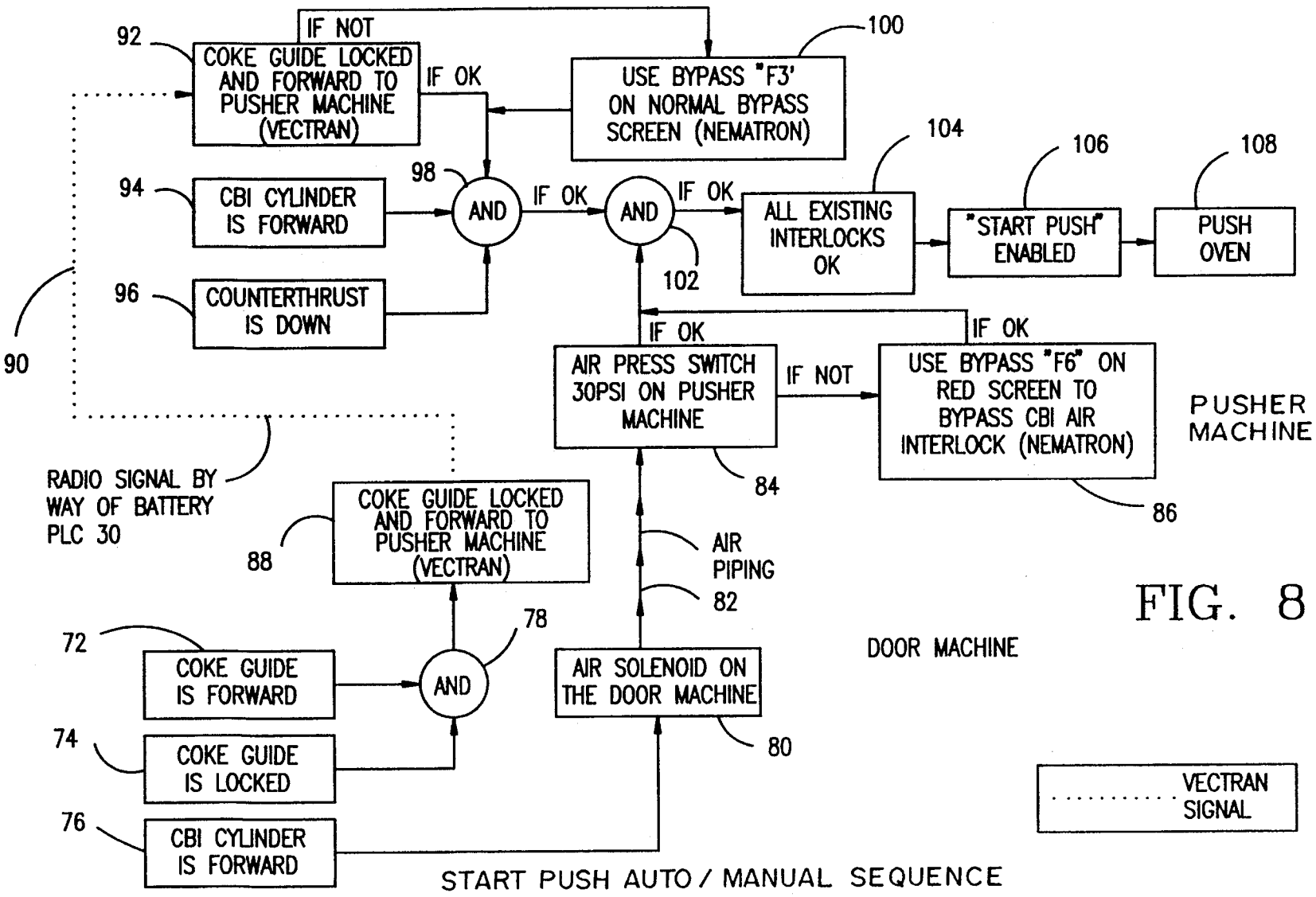
FIG. 8 is a simplified flow chart illustrating the start of the push sequence with interaction of the door machine operations (bottom half) and pusher operations (upper half)

FIG. 8 shows the start of the push sequence with interaction of the door machine operations (bottom half) and pusher operations (upper half). Before the pusher begins pushing, various other operations must be performed. The coke guide is brought forward at block 72, locked at block 74, and the CBI (cross-battery interlock) cylinder is brought forward at block 76. Upon those conditions occurring, AND gate 78 and block 76 cause the air solenoid on the door machine 80 to operate in generally well known fashion to supply pressurized air through air piping 82. IF the air pressure isn't detected by the block 84 at the pusher, the pusher will not operate unless an operator bypasses the block 84 at block 86. (The operator would do so if it appears that the door machine and pusher are at the same oven, but air pipe 82 is blocked or switch of block 84 malfunctions.) The use of air pressure interlock pipe 82 is known. What is different about the procedure of FIG. 8 is that block 88 is activated by gate 78 to send a radio signal along the dotted radio link 90 to block 92 at the pusher. The radio link 90 is by way of the battery PLC 30 (not shown), it being understood that all communication from one of the movable machines to another is by way of PLC or command controller 30. If the pusher CBI cylinder is forward at block 94, counterthrust is down at block 96, and block 92 indicates correct or OK conditions, AND gate 98 outputs an OK or logical one signal. (Block 100 gives an operator bypass to block 92.) Gate 102 outputs a logical one if both blocks 84 and 98 indicate conditions are right (or block 98 has a logical one output and block 86 has bypassed block 84).

Gate 102 leads to block 104 indicating all interlocks are OK or acceptable. The start push button is enabled at block 106 and push sequence begins at block 108. The FIG. 8 arrangement improves on the normal air interlock by also requiring the communication indicated at blocks 88 and 92 before the start push button is enable. This decreases the chances of costly and/or polluting errors.

Figure 9:
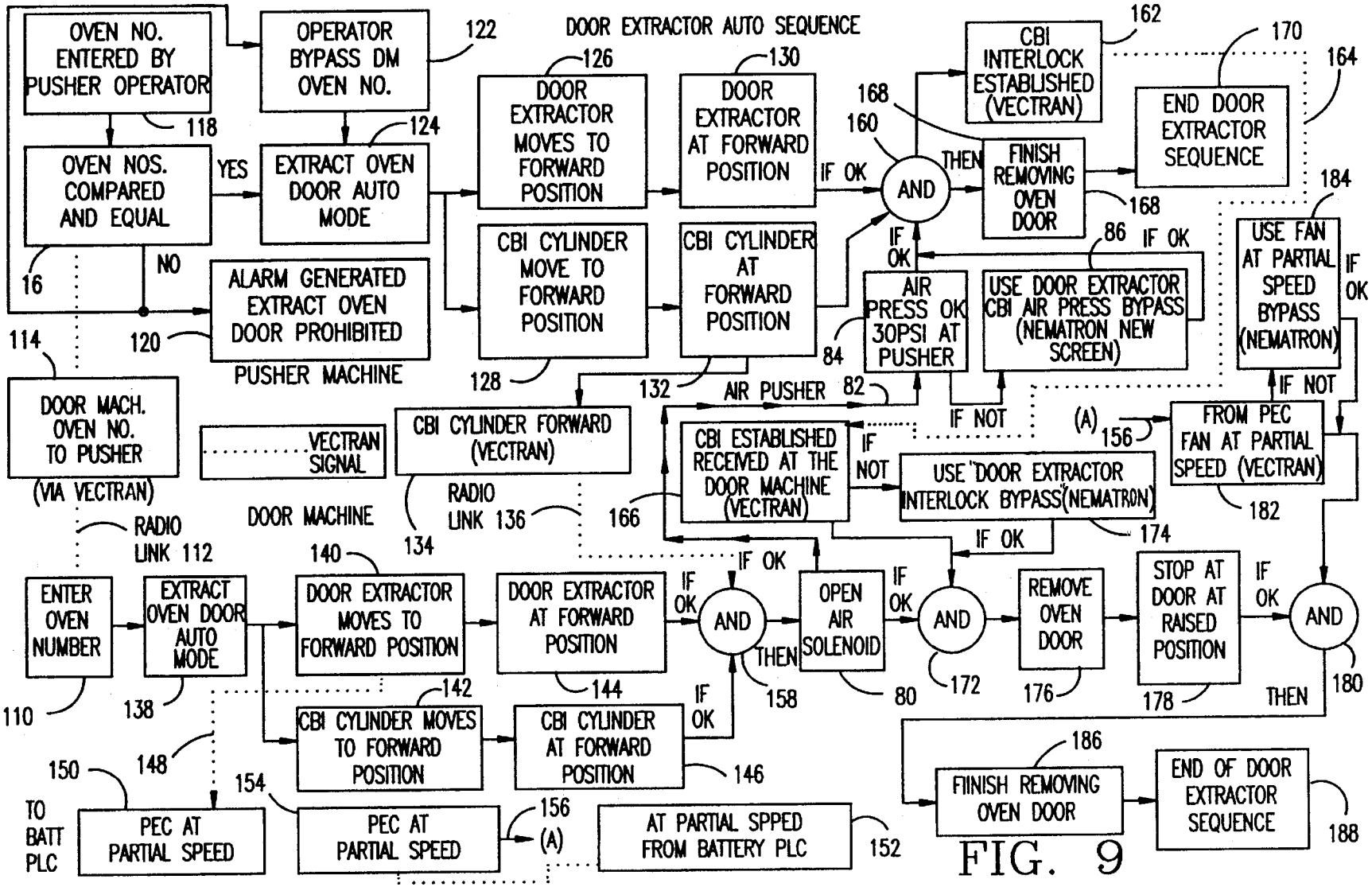
FIG. 9 is a simplified flow chart illustrating the door extractor automatic sequence with door machine operations at the bottom and pusher operations at the top half.

FIG. 9 shows the door extractor automatic sequence with door machine operations generally at the bottom and pusher operations generally at the top half. Since blocks/components 80, 82, 84, and 86 are the same as in FIG. 8, they need not be discussed in detail. At block 110, the door machine operator enters the oven number (this would be at the master or battery PLC 30 and transmitted through radio to the door machine) from which coke is to be extracted and at which the door machine is at. By way of radio link 112 and the command PLC or controller 30 (not shown in FIG. 9), the door machine oven number at block 114 is sent to block 116 at the pusher. At block 116, the door machine oven number is compared to a pusher oven number entered at block 118 (this would be at the master or battery PLC 30 and transmitted through radio to the pusher machine) by the pusher operator. If the two oven numbers entered by the operators are not equal, alarm block 120 blocks door extraction absent operator override at block 122. If the oven numbers are equal (or the override was activated), control passes to block 124 which starts the oven door extraction. Block 124 leads to block 126 which moves the door extractor to forward position and block 128 which moves the CBI cylinder to forward position. Those blocks respectively lead to blocks 130 and 132 testing for proper operation of the extractor and cylinder. Block 132 signals proper cylinder positioning to the door machine by way of block 134 and radio link 136. (As discussed previously, all radio links from one movable machine to another are by way of the command or battery controller 30.)

The oven number at block 110 leads to block 138 to put the door machine side oven door in automatic extract mode and leads to blocks 140, 142, 144, and 146 which perform the same functions for the door machine as respective blocks 126, 128, 130, and 132 perform for the pusher. Additionally, block 140 is radio linked by link 148 to block 150 which causes the pushing emissions control (PEC) system to come to partial speed. When block 152 indicates that the PEC is at partial speed, this goes to block 154 by radio link 153. Block 154 generates an output at 156 which will be used in a manner discussed below.

Blocks 144 and 146 lead to AND gate 158, which also receives an input from radio link 136. Gate 158 leads to block 80 operating with 82, 84, and 86 as discussed above. Gate 160 in the pusher leads to block 162 and, by radio link 164, to block 166 confirming CBI at the door machine.

Gate 160 leads also to blocks 168 and 170 which respectively finish removing the pusher side oven door and end the pusher side sequence.

Block 80 leads also to gate 172 which receives an OK from block 166 (or override block 174). Gate 172 leads to block 176 which removes the door machine side oven door. Next, block 178 stops the door at raised position and, if OK, so indicates to AND gate 180. Gate 180 also receives an indication if the PEC is at partial speed from block 182

(having operator bypass at block 184). Gate 180 leads to blocks 186 and 188 which respectively finish removing the door machine side oven door and end the door machine extraction process.

Figure 10:
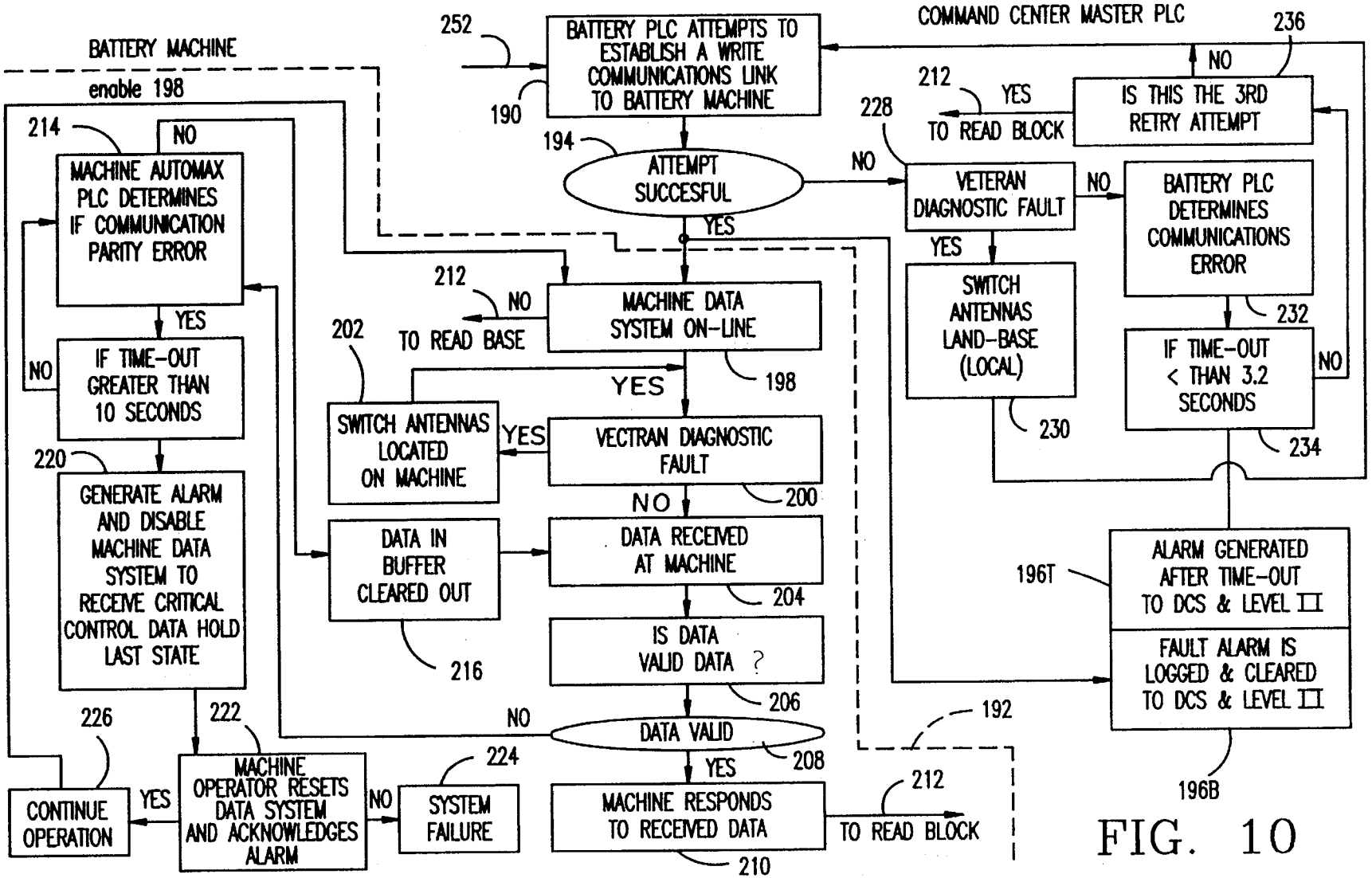
FIG. 10 is a flow chart illustrating the command or master controller attempting a write operation to a machine or slave unit.

FIG. 10 shows how the command or master controller PLC 30 of FIG. 2 attempts a write operation to a machine or slave unit corresponding to one of the movable machines in the battery. At block 190, an attempt is made to write (transmit) to a battery machine which performs the operations below and to the left of dotted line 192. If the write attempt is successful, block 194 so indicates to the bottom half block 196B which clears the fault alarm if it was generated by 196T. Also, the successful attempt leads (by radio link, not shown) to block 198 which selects machine on or off line and resets if on line. This leads to block 200 which tests for a diagnostic fault (improper spreading code or weak signal, again Vectran is a particular brand of transceiver) and may switch antennas at block 202 using the process shown in detail in FIG. 6. Upon there being no fault, block 204 receives the data and block 206 tests for validity (using the FIG. 7 process). If data is valid, block 208 leads to block 210 where the machine responds to the data. For example, a pusher begins pushing upon receiving a signal so instructing it. Block 210 leads to flow line 212 which initiates a read operation discussed later relative to FIG. 11.

If block 208 indicates invalid data, control goes to block 214 which tests for a parity error (FIG. 7 process). If there is no parity error, block 214 leads to block 216 which cleans out the data in the buffer and returns to block 204. If there is a parity error, block 214 leads to block 218 which returns to block 214 unless a time out period of 10 seconds is exceeded. If time out is reached, block 218 leads to block 220 which generates an alarm and blocks the machine from receiving critical control data and holds it in state. Block 220 leads to block 222 which leads to system failure block 224 unless the operator resets in which case block 226 continues operation and returns control to block 198. If block 198 indicates that it is not on-line, control goes to line 212 to be discussed below.

If block 194 indicates that the write operation was unsuccessful, control goes to block 228 to test for a diagnostic fault. If a fault is detected, block 230 switches the land based antennas corresponding with the particular machine and returns to block 190. If no fault, the battery PLC 30 checks for communications error at block 232. If block 234 indicates a time out greater than, for example 3.2 seconds, block top half 196T generates an alarm. The time interval of 3.2 seconds is chosen in the example because each read or write takes ½ second. The time interval is not reset until there has been a successful read or write (communication between battery PLC and given machine). If there are 3 unsuccessful read attempts and 3 unsuccessful write attempts (in either order) in a row, the 3.2 second time out will cause an alarm condition informing the operator of a problem. Even then, the system will continue repeatedly trying to read and write until communication is reestablished. An alarm from this happens very rarely due to the high reliability of the system.

If no time out occurs, block 234 goes to block 236 which tests if this is the third write attempt. If so, block 236 goes to line 212 which leads to a read attempt in FIG. 11 discussed below. If it is not the third attempt, block 236 returns to block 190.

Figure 11:
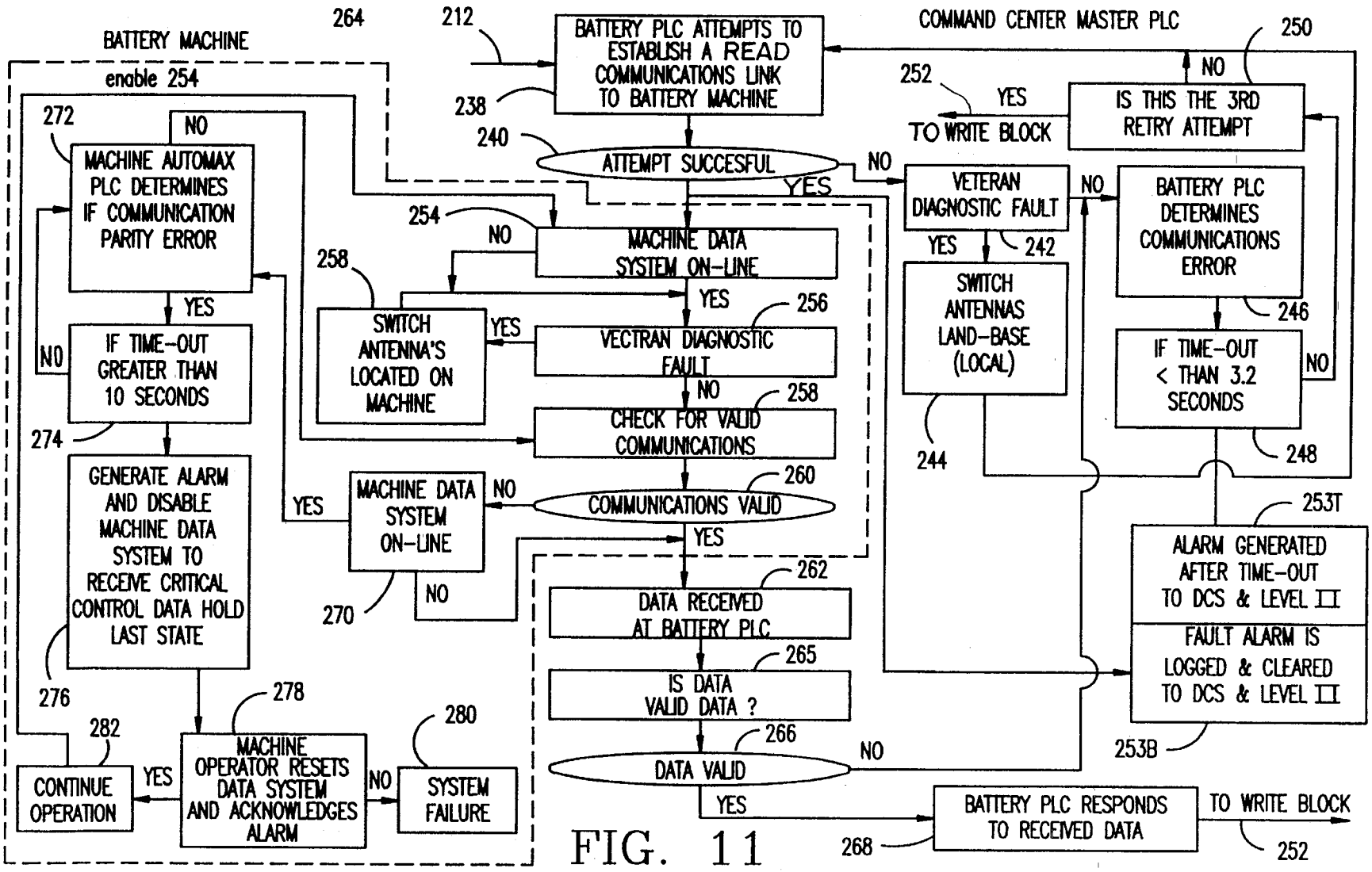
FIG. 11 is a flow chart illustrating the command or master controller attempting a read operation to a machine or slave unit.

FIG. 11 is a flow chart illustrating the command or master controller PLC 30 attempting a read operation to a machine or slave unit beginning at block 238 which receives line 212 from FIG. 10. Block 238 leads to block 240 which tests for a successful read. If not, blocks 242, 244, 246, 248, 250, 253T, and 253B operate in the same fashion respectively as blocks 228, 230, 232, 234, 236, 196T, and 196B of FIG. 10. If block 250 indicates that a third read attempt is made without success, control goes to line 252 which is an input to block 190 (refer back momentarily to FIG. 10).

Blocks 254, 256, and 258 of FIG. 11 operate respectively like blocks 198, 200, and 202 of FIG. 10 except that the "no" output of block 254 goes to block 256. If no fault is detected, block 256 leads to block 258 which checks for valid communications. If valid, block 260 leads to block 262. Those blocks within 264 occur within the battery machine, whereas those outside of it take place within the command or master PLC 30, it being understood that the various radio links allow connection between the battery machine and PLC 30.

Block 262 indicates successful receipt of data at the battery from the slave (machine) PLC, which is preferably an Automax brand PLC. Block 262 leads to blocks 265 and 266 checking for data validity. If not valid, control goes to block 246. If valid, block 266 leads to block 268 which has the battery PLC 30 responding to the data received by it and going to line 252 which returns to FIG. 10.

If block 260 indicates that no valid communications are established, control goes to 270 if selected on-line. If not, block 270 leads to block 262. If selected on-line, block 270 leads to block 272 where the battery machine or slave PLC (Automax) checks for communications error. If none, control goes to block 258. If there is a communications error, block 272 leads to blocks 274, 276, 278, 280, and 282 which operate in the same fashion respectively as blocks 218, 220, 222, 224, and 226 of FIG. 10.

The overall operation of FIGS. 10 and 11 means that a write or read operation is attempted three times before trying the opposite operation (read or write). If spreading code or signal strength problems are detected, an antenna switch is made.

Figure 12:
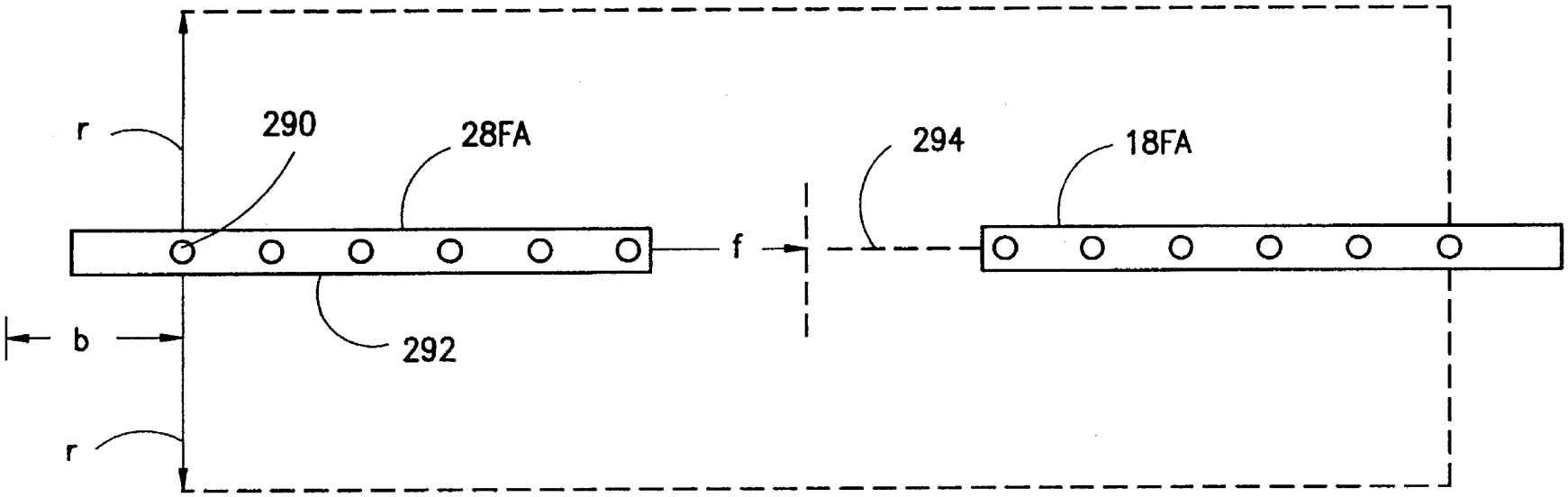
FIG. 12 shows a simplified side view of antenna placement.

FIG. 12 shows an antenna placement feature of the invention. Although it shows a simplified side view of one of the land pusher Yagi antennas 28FA aimed horizontally leftwardly and the corresponding pusher machine Yagi antenna 18FA aimed rightwardly in the line of sight and co-linear with antenna 28FA, it will demonstrate clearance conditions which should be used for each land antenna and corresponding machine antenna.

The back element 290 (horizontal bar, appears circular in side view) of antenna 28FA would have a clearance of b behind it, meaning that there is no substantial metallic or concrete structure behind element 290 within the distance b. As used herein, a substantial metallic or concrete structure would be one which interferes with reception at a given frequency. Preferably, excluding any antenna mount structure (which might for example be a metallic pipe, not shown, having a U bolt to which the antenna is mounted), there are no metallic or concrete structures behind the antenna within distance b from back element 290. The distance b is at least one wavelength of the frequency of antenna operation. More preferably, it is at least three wavelengths. The wavelength would be about one foot or ⅓ of a meter in the preferred case such that b is at least one foot and preferably 3 feet or more. The back clearance criteria would preferably be met by each of the land and machine based antennas used in the system.

As shown, there should be a clearance (i.e., no substantial metallic or concrete structures) within distance r of the central member 292 of the antenna, which clearance should extend at least distance f in front of the antenna 28FA. More preferably, there is complete clearance (i.e., no metallic or concrete structures) within distance r of the central member 292 of the antenna, which clearance should extend at least distance f in front of the antenna 28FA. The distance r should be at least 3 wavelengths, more preferably at least 5 wavelengths. Using the preferred frequencies, the distance r would be at least 3 feet, preferably at least 5 feet. The distance f should be at least 3 wavelengths, more preferably at least 5 wavelengths. Using the preferred frequencies, the distance f would be at least 3 feet, preferably at least 5 feet. Moreover, in addition to having free line of sight and co-linear relationship between corresponding machine and land antennas such as 18FA and 28FA, complete clearance or at least clearance should be maintained in the radius r all along the line of direction 294 of the antennas 18FA and 28FA.

The Battery Communication System as installed provides for the following controls and information: 1). Real-time control and interlocking between the following equipment; Pusher Machine, Door Machine, Coal Charging Car, Quench Car and Battery Pushing Emissions Control System; 2). Alarm and process analog information to the Distributed Control System (Rosemount RMV 9000) and 3). Digital and process analog information used by the Battery Level 2 Computer for Battery Pushing Schedules and other reports and information necessary to operate the Battery within its design criteria.

Real-time Control of the Oven Machinery is accomplished by series of control modules: 1). the Battery PLC (Central Processing Unit) and Hardware necessary to link communication to the radio frequency modems, including software for both the Battery PLC and the ASCII Basic module, 2). the Vectran VR-30 Radio Modem, including modifications to the standard unit, expressly required by National Steel as necessary to allow real-time control without interruption of Radio Frequency signal, 3.) the Hardware and software as supplied by Reliance; Automax Control System with Modbus card, interface line driver modem, and the VR-30 Vectran radio modem and 4). miscellaneous hardware necessary to electronically make the system function.

The system operates with a total of 12 Vectran VR-30, radio modem units. Each pair of machines, Pusher Machine, Door Machine and Coal Charging Car requires a modem unit with one unit remote and located on the machine and one unit local, located at different locations around the Battery Complex, called 'Land based units'. These units are electronically identical and operate in pairs. The Quench Car utilizes a Vectran VR-20 full duplex unit and is essentially stand alone system and provides interlocking within the 'System' and some machine status information as will be described later.

Within this control system we will consider the control systems mounted on the machines as the 'Slave' or 'Remote' units. The Battery PLC located at the Command Center is the 'Master' control processing unit. The Battery PLC software program is configures to interrogate each of the Machines, excluding the Quench Car for: 1). ASCII Basic Module status, 2) Modem System 'On Line' and 'In Communications', 3). Valid communications, 4). Machine Status; 'In' or 'Out' of Service and equipment operating condition and 5). Nine-hundred plus unique alarms from all eight machines, and this totals nearly 1200 bits of information from all six machines in 6 seconds or less and at an average of three seconds.

The Quench Car is interrogated by the Battery PLC as to 1). Modem System 'On Line' and 'In Communication', 2). Valid communications and 3). System on By-pass due to a malfunctioning Vectran unit located on the car or at the Electrical Equipment Room #1.

The main function that the Battery PLC software provides, is to direct the proper control signals between the machines 'In Service', so that consistent operating practices are maintained, delays are minimized and fugitive Emissions are held within proper limits.

Individual Item Descriptions

1. ASCII Basic Module Status—The PLC is configured to give a diagnostic alarm upon failure of the module that does the communication between the PLC and the Vectran VR-30 modem unit. In this case corrective action must be taken or a decision must be made to change to the Stand-by machine.

2. Modem System "On Line" and "In Communication"—Each machine is monitored by the Battery PLC using a transmitted and received 'toggle bit', which confirms that the system is in communication. Another 'bit' is sent from each Battery machine, indicating whether the machine is "On Line" or active.

3. Valid Communications—Valid communications is determined both at the Battery PLC and by the Automax PLC on each machine. The Battery PLC notifies the DCS when successful communications have not been accomplished within a prescribed length of time. This alarm is logged by both the DCS and the Battery Level 2 computer, and print outs are available for both. In the case of the Battery PLC, it continually tries to establish a 'communication cycle'. A good transmission and a good reception of the required data bit, either confirm that we are in proper communications, or continues to attempt communications and gives an alarm that we have failed to communicate. On the machine if proper communication is not established within a prescribed length of time then the machine will give a 'Fault' and suspends information coming to the machine. Outgoing data is allowed to the Battery PLC and to other machines unless the machine determines a Communication Fault. When communication is re-established the 'Fault' on the machine has to be acknowledged and cleared to enable data to be received by the machine. A communication fault is determined in software similar to the Battery PLC but uses additional data bits to determine precisely that the communication is enabled and correct data is being received.

4. Machine Status—Each machine is able to provide its status as either 'In Service' or 'Out of Service'. In addition each pair of machines provides approximately 300 status and alarm points which is recorded by the Rosemount DCS System. This allows us to observe malfunctions and problems as they occur.

5. There are approximately 12 DCS graphic screens that allow the operating foreman the ability to view these signals as they are transmitted between machines.

Technical Description of the Battery PLC Communications to the Oven Machines

The Battery PLC communicates to the Coke Oven Machines. The function of these communications is to 'Read' alarm and control data and to 'Write' control data and to act on this data as the Master in a system. Information in this arrangement is sent from one machine to another (from the Battery or 'Central processing' system to a machine or 'Remote' system).

The PLC has an ASCII Basic module dedicated for each oven machine—six in all. Each ASCII basic module requires a byte of I/O memory. Reference drawing H-63352 for I/O addressing. The Basic module is required for the serial communications from the Battery PLC to the Vectran 'Half Duplex' modems. The CPU of the PLC performs the controlling logic required of the Master functions. The Basic card is a device that serves as a means of conveyance of data from the PLC to the Radio Frequency modems.

The PLC must Read and Write to each machine. It performs this function via a 'Block Move' function in the GE PLC logic. There are five words of data required for the 'Block Move' statement:

| | |
|---|---|
| Word 1 | Defines the 'Drop' number of the machine address (2 thru 7). |
| Word 2 | Defines a READ or WRITE function. A '4' represents a READ function; a '16' represents a WRITE function. |
| Word 3 | Is the starting address area of the machine 'Read' or 'Write' address. |
| Word 4 | Is the number of words to be Read or Written. |
| Word 5 | Is the starting address of the Series 6+ address where the information is to be written to or read from. |

The PLC uses 4 bits of the Basic module input address for control purposes. These bits momentarily pulse 'On' and 'Off' and are defined as follows:

| | |
|---|---|
| Bit 1 | Communications is successful; The Basic Module/ Vectran performed a Query and received a valid Response |
| Bit 2 | Status Error Time out - Communications is unsuccessful; The Basic Module/Vectran performed a Query and did not receive a Response |
| Bit 3 | Bad CRC - Communications is unsuccessful; The Basic Module/Vectran performed a Query and received a Response, but the Response was garbled and invalid |
| Bit 4 | Function Not Supported - Communications is unsuccessful; The Basic Module/Vectran performed by a Query and received a Response, but the response was a function not supported. |

The PLC will attempt a READ and after a successful attempt will attempt to WRITE. If the PLC determines communications was unsuccessful, it will retry the same READ or WRITE statement at least two additional times. If a successful READ (or WRITE) is not obtained after the third attempt, the PLC tries the inverse operation and so forth.

The PLC writes several WORDS to each machine. The PLC alternates or toggles the 1st Bit of the 1st Word on each write statement. On one scan the bit is held 'High' then on the next Write the Bit is held 'Low'. The last Bit of the 1st Word is always the opposite state of the 1st Bit; Bit 0 is 'High' then Bit 15 is 'Low'. The 13 Bit of the 1st Write Word is always held 'High'.

Each machine then takes the toggle Bit of the 1st Write Word sent to it from the Battery PLC and places it in the 1st Read Word. Therefore, the Battery PLC sees its own change of state with each 'Read' and 'Write' command. A change of state will only occur if successful Read and Write commands are present.

The Basic Module has several lines of Basic code. All Basic Modules have the same code with the exception of the 'target' registers of the PLC 'Read' and 'Write' statements. Target register area is found on line 180 of each basic code. Lines 168 and 169 are the status area time out times of the read/write statements. Both lines must have the same constant. If the constant is to 'Low' the Basic Module will indicate a time out error before the 'Remote' Vectran unit has sufficient time to respond. If the constant is to 'High', to much time may pass before the PLC determines an error has occurred. It is better to have to 'High' of a number then a 'Low' number.

Description of Specific Control Strategies: Below see a detailed list of the machine data signals used for communication status and machine interlocking:

Pusher Machine—Data Signals from Machine to Battery PLC

1. Data System On-Line
2. Machine 'Active'
3. CBI cylinder forward to the Door Machine
4. Prepare/Level permissive to the Charging Car
5. Send the Emission Fan to full speed
6. Send Emission Fan to idle speed
7. Pusher Ram started to Command Center and Level 2 system
8. Pusher Ram Finished to Command Center and Level 2 system
9. Ram is fully extended through the Coke Guide
10. Push Finished—Coke Guide retracted from Coke Guide to Door Machine
11. Pusher is Levelling
12. Levelling is completed
13. Door Cleaner cycle not completed
14. Jamb Cleaner cycle not completed
15. Fan at full speed 'Bypassed'
16. Ready for Levelling 'Bypassed'
17. Quench Car Ready for Push 'Bypassed'
18. Quench Water tank full 'Bypassed'
19. Cross Battery Interlock 'Bypassed'
20. Coke Guide Forward and Locked 'Bypassed'
21. Door Extractor Cross Battery Interlock 'Bypassed'
22. Machine Out of Service Pusher Machine—Data Signals to Machine from Battery PLC 1. Data System On-Line (Toggle bit to Pusher Machine)
2. PEC Ready to Operate
3. PEC Fault
4. PEC Fan at Full Speed
5. Two Pusher Machines are Active
6. Pusher Machine is Spotted and Ready for Levelling
7. Charge Finished from the Coal Charging Car
8. Quench Tank is Full
9. Ready for Push from the Quench Car
10. PEC Fan is at Idle Speed
11. Coke Guide Forward and Locked from the Door Machine
12. Start Levelling signal from the Coal Charging Car
13. Clock Reset (Every Minute)
14. Communications Health Bit (Always set Hi)
15. Data system OK (Alternate status bit from Item 1 above)
16. Time in Hours
17. Time in Minutes 18. Oven Number sent from the Door Machine Door Machine—Data Signals sent from Machine to Battery PLC 1. Data System OK (Toggle bit from Door Machine to Battery PLC)
2. Door Machine Active
3. Emission Fan to Partial Speed
4. Door Cleaner Cycle Not Completed
5. Jam Cleaner Cycle Not Completed
6. Quench Car in Push Position
7. Emission Fan to Idle Speed
8. PEC Ready 'Bypassed'
9. Fan at Partial Speed 'Bypassed'
10. Fan at Idle Speed 'Bypassed'
11. Push Complete 'Bypassed'
12. To Pusher Machine 'Cross Battery Interlock' Bypassed
13. Interlock Not Received from Pusher Machine to Extract Oven Door
14. Coke Guide Forward and Locked
15. Oven Number Entered.
16. Door Machine and Pusher Machine Oven Number Not Equal
17. Machine in Maint. Mode
18. Machine 'Out of Service'
19. Oven Number 'Not' Entered.
20. Oven Number
21. Oven Number to Pusher Machine via Battery PLC Door Machine—Data Signals to Machine from Battery PLC 1. Data System OK (Toggle Bit from Battery PLC to Door Machine)
2. PEC Ready to Operate
3. PEC Fault
4. Emission Fan is at Partial Speed
5. Emission Fan is Idling (Cooling Finished)
6. Two Door Machines are Active
7. Push Finished—Retract Coke Guide
8. Cross Battery Interlock Cylinder Forward from Pusher
9. Cross Battery Interlock Established from Pusher Machine to Extract Oven Door
10. Reset Clock (Every Minute)
11. Health Bit (Always Hi)
12. Data System OK (Alternate Toggle Bit from Battery PLC to determine that correct data has been received
13. Time in Hours
14. Time in Minutes
15. Pusher Oven Number to Door Machine via Battery PLC Coal Charging Car—Data Signals from Machine to Battery PLC 1. Data System Healthy (Toggle bit from Coal Charge Car)
2. Charge Car 'Active'
3. Prepare to Level
4. Finished Charging
5. Coal Charge Car at East Bin
6. Coal Charge Car at West Bin
7. Record coal weight 'Unloaded'
8. Record coal weight 'Loaded'
9. Start Charging
10. Lid and Frame Cleaning Completed
11. Weight Empty Recorded 'Bypassed'
12. Weight Full Recorded 'Bypassed'
13. Levelling Finished 'Bypassed'
14. Prepare/Level Permissive to Charge 'Bypassed'
15. Start Levelling
16. High Pressure Liquor Aspiration Failure 'Bypassed'
17. Oven Number
18. Screw 1, 2, 3 and 4 Revolution counter set point
19. Screw 1, 2, 3, and 4 Actual Screw Counts
20. Screw 1, 2, 3, and 4 Actual Screw Speed
21. Coal Charge Car 'Out of Service'

Coal Charge Car—Data Signals to Machine from Battery PLC

1. Data System OK (Toggle Bit to Battery PLC)
2. Two Coal Charge Cars are 'Active'
3. Leveller is Levelling
4. Levelling is Finished
5. Weight 'Unloaded is Recorded'
6. Weight 'Full is Recorded'
7. High Pressure Aspiration Failure
8. Prepare/Level Permissive to Charge
9. Clock Reset (Every Minute)
10. Health Diagnostic Bit (Always Hi)
11. Data System OK (Alternate Toggle Bit to determine correct data has been received)
12. Charge Weight from Battery PLC/DCS
13. Time is hours
14. Time in minutes
15. Levelling Oven Number from Pusher Machine
16. Scale Weight from Battery PLC
17. Flushing Liquor Pressure Quench Car—Signals from Quench Car to Battery PLC 1. System Active
2. Start Quench
3. Ready for Push
4. Quench Car System Normal
5. Two Quench Cars Active Quench Car—Signals to Ouench Car from Battery PLC 1. Push Complete
2. Drain Complete
3. Quench Car in Position
4. Quench Car System 'On Bypass'

MAJOR CONTROL STRATEGIES

The following control strategies help make the present invention unique. These control strategies are implemented by software and/or hardware using the described communication system for conveying data from each machine to the battery PLC 30 or to other machines via the battery PLC. The details of control strategies 1 and 2 below are in FIGS. 8 AND 9 and the related discussion above.

1. The system utilizes the air cross battery interlock system to make sure that the oven doors are being removed on the SAME oven by the Pusher Machine and Door Machine. Another safeguard that was included was the oven numbers entered by the machine operators also had to match before the doors can be allowed to be removed. These numbers are sent from the Door Machine to the Pusher Machine and interlocked on the Pusher Machine before the Pusher Side Door can be removed.

2. Pusher and Door Machine Door Removal Interlocking—After the operator spots up either the Pusher Machine or the Door Machine, he or she must enter by "keypad" the oven number to allow removal of the oven doors. The main interlock is provided for on the Pusher Machine only and, if these numbers match, then we must assume that the machines are spotted at the same ovens. At this point, the operators press the automatic pushbutton "Extract Oven Door," and the door extractor on each machine will start its sequence. At this time, the CBI cylinders on each machine will be allowed to travel to their forward position. When the CBI cylinder on the Pusher Machine reaches its forward position, a Vectran signal is sent to the Door Machine, "CBI cylinder forward." When this signal is received and the CBI cylinder on the Door Machine is forward, the interlock is completed. The CBI air solenoid is now energized, allowing air to flow through the Cross Battery Interlock piping to the Pusher Machine and activate the CBI air pressure switch, double confirming that the machines are at the same oven. When the air pressure switch on the Pusher Machine is activated, another Vectran signal is sent to the Door Machine confirming that "CBI Is Established." When the above interlocks are met, then the door removal process continues. The door on the Pusher side will be removed. The door on the coke side will only be fully removed if the interlock from the Baghouse is received that the Emission Fans are at "Partial Speed." With this interlock made, the door then is removed. At the same time the doors are being removed, the CBI air solenoid is de-energized on the Door Machine to conserve air pressure. When the signal is confirmed between the Pusher and Door Machines, the CBI signal is no longer necessary until the "Prepare to Push" sequence is started.

3. The Coal Charge Car has been outfitted with a resolver that indicates oven position and is accurate at 100%. The Coal Charge Car also receives the oven number "to be Levelled" from the Pusher Machine to indicate at what oven the Pusher Machine is spotted up at and is "Ready to Level." The operator also has a keypad and enters the number of the oven to be "Charged." If these three numbers match, the primary interlock to allow the "Charge" is completed.

4. The Coal Charge Car communicates with the Pusher Machine to coordinate the "Charging" and "Leveling" Sequence. The Pusher Machine sends a signal to the Coal Charge Car that the Pusher Machine is "Ready and in Position to Level." When the Coal Charge Car removes the "Lids" and drops all four telescopes and the permissives in Item #2 are met and has also confirmed that the High Pressure Liquor is within proper limits, then the Coal Charge Car operator gets an "OK to Charge" indicating light. At this point, the operator presses the Start Charge button and the "Charge" is started. As the "Charge of Coal" nears completion, the Pusher Machine receives a signal to "Prepare to Level" and automatically opens the Leveler Door and moves the Level Bar up to the door opening. As the screwfeeders go into "Level" speed and the proper revolutions are achieved, another signal is sent to the Pusher Machine to "Start Leveling." As the Coal Charge Car reaches zero counts on all screwfeeders, another signal is sent to the Pusher Machine to "Stop Leveling" and closes the Leveler Door. After the Leveler Door is closed, a signal is sent back to the Charge Car that indicates "Finish Charge" that raises the telescopes and replaces the lids. This sequence is done exactly the same every "Charge."

5. In addition to the Leveling sequence as mentioned above, we have since installed an ending sequence to the leveling operation called "The Final Stroke." After the Charge Car has completed the charge fully, the Pusher Machine retracts the Level Bar to the middle of the standpipe and makes a final stroke from end to end. This is adjustable to up to three complete re-levels.

Figure 13:
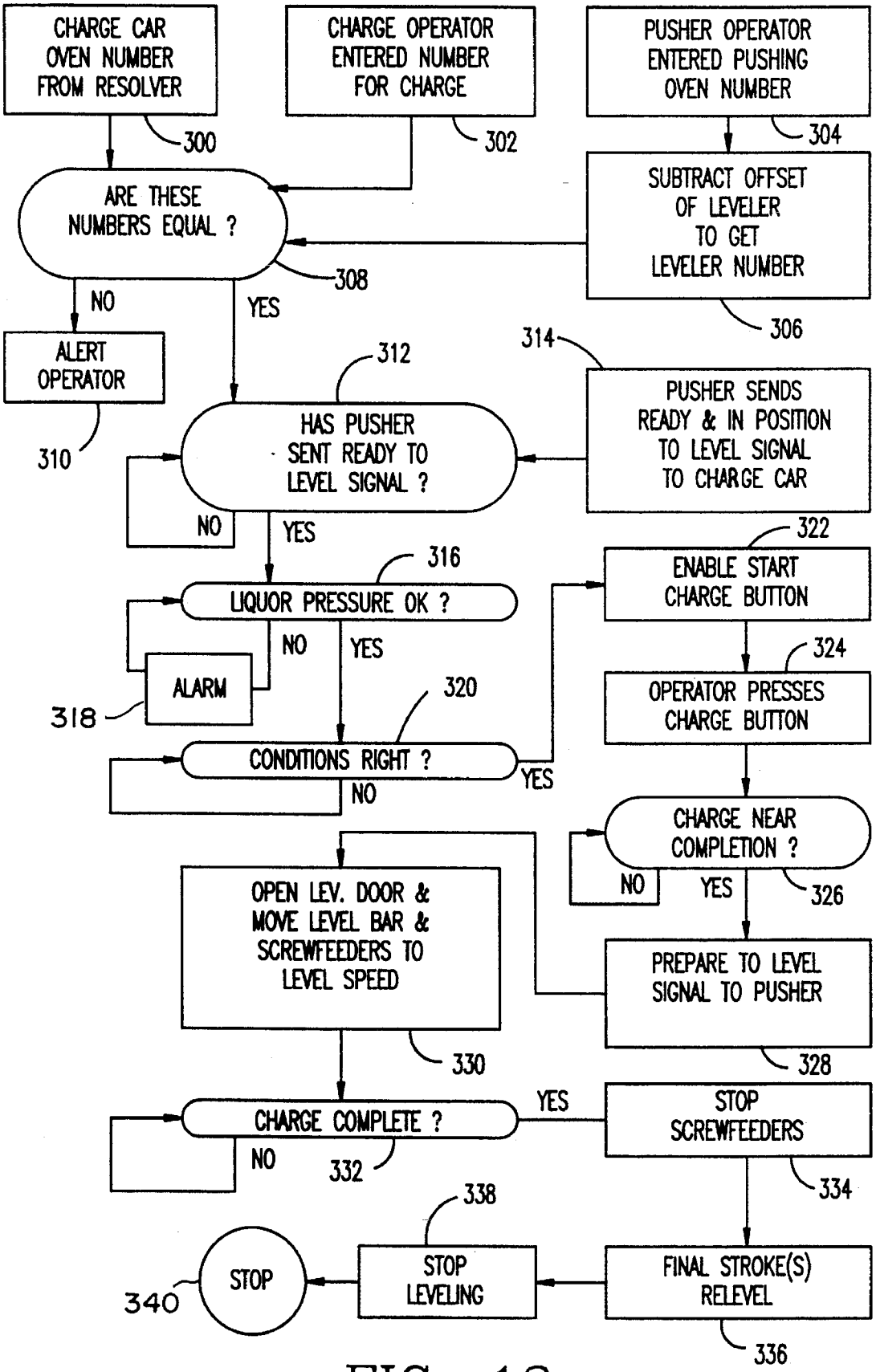
FIG. 13 is a flow chart of a charge and leveling procedure.

The details of strategies 3, 4, and 5 will be discussed with reference to FIG. 13, which is a simplified flow chart. Blocks 300, 302, and 304 respectively involve the sensing (block 300) or entry (blocks 302 and 304) of sensed charge car oven number, entered charge car oven number, and pusher oven number. Since the pusher has a leveler thereon which is offset (2 oven offset distance in preferred design) from the actual pushing mechanism, block 306 subtracts the offset from the pushing oven number. Thus, if oven number 20 was entered at block 304 and the offset is two ovens, block 306 would output oven number 18 for comparison at block 308 with the sensed charge car oven number from 300 and the entered charge car oven number from 302. If all three numbers are not equal, the operator will be alerted at block 310 by alarm or otherwise. If the three numbers are equal, block 308 leads to block 312 which checks if the pusher has sent the ready and in position to level signal to the charge car from block 314. When sent, control goes then to block 316 which checks if the liquor pressure is OK. If not, alarm 318 is operated. If pressure is OK, block 320 then checks if conditions are right (lids removed, telescopes dropped, and criteria of strategy 2 above satisfied). When conditions are right, the start charge button is enabled at block 322 and the operator presses it at block 324.

Next, block 326 uses counters on the screwfeeders to determine when the charge is near completion at which point control passes to block 328. Block 328 sends the prepare to level signal to the pusher, whereupon block 330 includes opening of the leveler door, moving the level bar, and slowing the screwfeeders to level speed.

Upon block 332 next indicating that the charge is complete, block 334 stops the screwfeeders and block 336 performs the final leveling stroke or strokes as discussed for strategy 5 above. Block 338 stops the leveling and leads to stop block 340.

6. The Door Machine and Pusher Machine also send signals to the Pushing Emission System. These signals raise or lower the Fan Speed to "Partial Speed" to remove the Coke Side Door or "Full Speed" to Push Coke into the Quench Car and to "Cooling" and "Idle Speed" when the push has been completed. The Baghouse also confirms back to each of the machines its present condition: (1) PEC Ready, (2) PEC Fault, (3) Fan at Idle Speed, (4) Fan at Partial Speed and (5) Fan at Full Speed. When the Baghouse is faulted or Not Ready, then a "Push" cannot be "Started."

Figure 14:
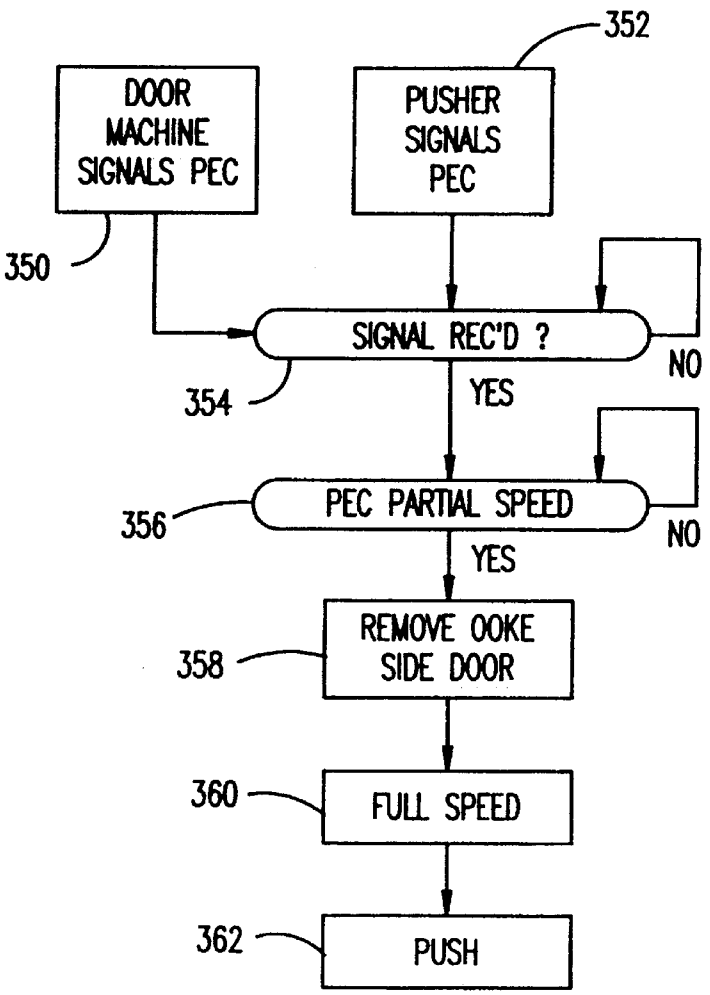
FIG. 14 is a simplified flow chart relative to the door machine and pusher.

FIG. 14 shows a simplified flow chart of the strategy 6 where the door machine and pusher respectively signal the PEC at blocks 350 and 352. When the PEC receives those signals at block 354, it goes to partial speed and so signals the system at block 356. Next, block 358 has the door machine removing the coke side door. Block 360 then brings the PEC to full speed, after which full speed status of PEC is sent to the pusher and door machine to enable the push at block 362.

7. Coal Charge Car—The Charge Car needs to take on a load of coal every time it charges the oven. The Charge Car spots up under one of the two Coal Towers and takes on coal automatically. A signal is sent to the Battery PLC that the Charge Car needs to "Weigh Car Empty." After the Car has been weighed, a signal is sent to the Coal Charge Car that the "Empty Weight Recorded" and the Bin Gate can now open. The car is now being filled. If any of the four loading holes plug up, a signal is sent from the Charge Car that the Air Blasters need to be actuated. On each charge, the Blasters can be actuated only twice. When the hoppers are full on the Charge Car, the Bin Gates close and a signal is sent to the Battery PLC to "Weigh Car Full." When the weighing procedure is completed, a signal is sent back to the Charge Car, "Full Weight Recorded," and the car is allowed to travel to its oven to charge coal.

Figure 15:
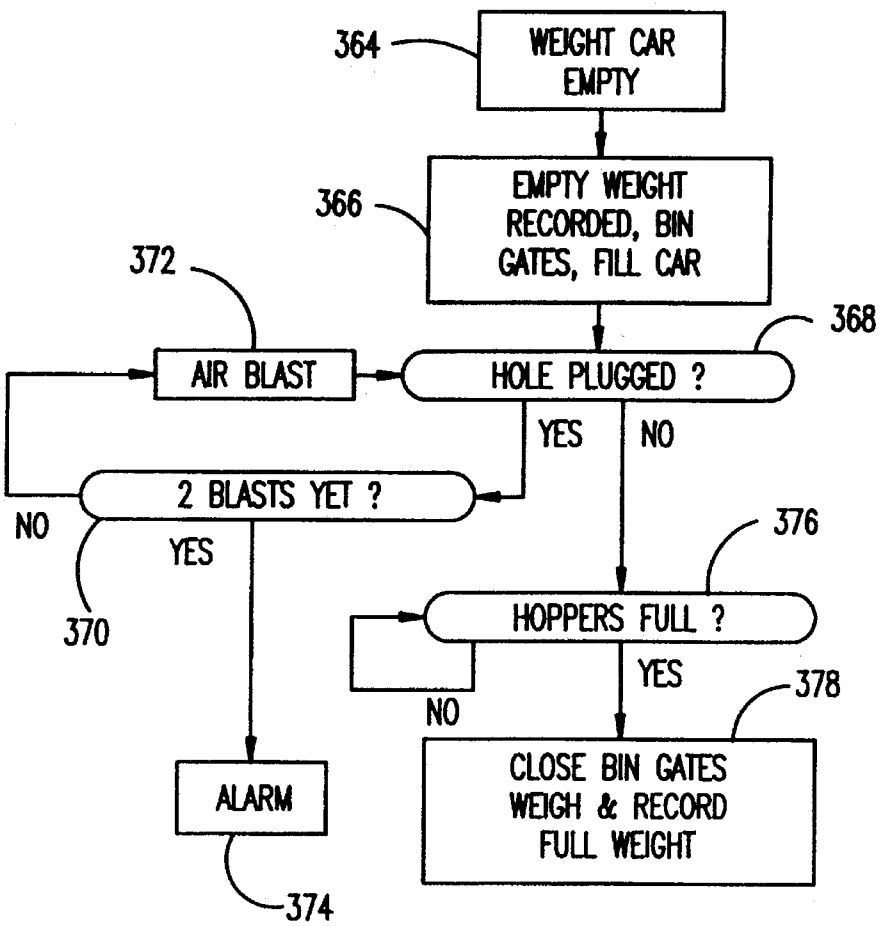
FIG. 15 is a simplified flow chart relative to a control strategy.

FIG. 15 shows a simplified flow chart of the control strategy 7. At block 364, the empty weight of the car is determined for recording at block 366 which also opens the bin gates and fills the car. Block 368 checks if any holes are plugged. If plugged, block 370 tests if 2 blasts have already been made. If not, block 372 actuates the air blasters. If 2 blasts have been made, block 374 indicates an alarm condition.

If block 368 indicates no holes are plugged, block 376 checks if the hoppers are full. When full, block 378 closes the bin gates, weighs and records the full weight.

8. We are now developing two new graphic screens for the Pusher Machine that allows viewing of the actual Ram Amps throughout the oven chamber. This information is also sent to our Level II computer which the operators can view and determine if a problem exists. The machine operator also has alarms which, when activated, will switch to one of the Ram Amp screens to visually show the extent of the problem. If a significant problem exists after examining the data as well as the oven, no further Charging of that oven will occur until the problem is corrected.

9. The Quench Car serves a very important role since it does not utilize an air interlock system for interlocking the "Push." The Quench Car has a relay circuit that is energized and held energized (to send enable for push) as long as the operator maintains his spot as determined by a long magnet and two limit switches located on the car. The Quench Car operator can "STOP" the push at any time by depressing the "Stop Push" pushbutton in case of emergency or mechanical failure of some part of the machinery.

The features of strategy 9 will be discussed relative to FIGS. 16–19. The door machine such as 16F of FIGS. 16 and 17 has a hood 400 (broken away in top view of FIG. 16) over quench car 402 riding on rails 404 under control of locomotive 406 in known fashion. However, a long bar magnet 408 is mounted to quench car 402 by way of bracket 410 (FIG. 17) for interaction with two limit switches 412 mounted to hood 400 by way of bracket 414. For ease of illustration, the brackets are not shown in FIG. 16.

FIG. 18 has block 420 which checks if the quench car is in position. If so, the limit switches 412 are closed by magnet 408 such that the door machine PLC (not shown) sends a signal to the battery PLC at block 422. The battery PLC at block 424 would then send a signal to the quench car indicating that the quench car is in position and this enables the quench car operator's button ready for push and that operator may press the ready for push button at block 426. This ready to push signal goes to block 428 such that the battery PLC tells the other machines that the quench car is ready for the push and the push is allowed or enabled at block 430.

If the quench car is not in position, block 420 leads to block 432 which goes back to block 420 unless a push has already been started. If a push has been started and block 420 indicates that the quench car is no longer in position, block 432 leads to block 434 which stops the push and signals an alarm condition.

BENEFITS REALIZED FROM USE OF THIS SYSTEM

Reliability is an important advantage of the invention. By use of spread spectrum, antenna switching and other features, reliability is extraordinarily high. Taking reliability to be the total seconds of errors of a month when the machines are in service over the total seconds of a month in which the machines were in service, a recent month yielded an error rate of below 0.06 percent. The reliability is thus higher than 99 percent, more specifically higher than 99.9 percent.

There are many benefits that are realized from the automation provided with use of the Vectran Radio Frequency modem as linked to the real time control of the Battery Machines. With the use of this system, the environmental releases are minimized. This is mostly due to the automation of the machinery and the continued redundant operation of the pushing and charging of each oven. Another important benefit is the ability of this system to send data to our Level II System. Vectran effects on the Level II System are as follows:

Battery Overview—Screens show the oven status from pushing time results.

Pushing Schedules—This system is greatly enhanced with Pushing and Charging Schedules. Without the automatic signals, all pushes and charges would have to be entered manually. This is not feasible when the schedules are constantly being updated, sometimes minutes before the start of making a new schedule.

Because Pushing Schedules are automated, they are:

1. More accurate!
2. Easier to read then the hand written!
3. Can be done in several seconds, instead of several hours!

Pushing/Charging Results—There are about ten reports that either partly or completely rely on the automatic data transmitted from or received by the Vectran Radio Frequency Modem system. Because of the automation and the accuracy of the data, operators have much less manual data to enter. The ability of other areas (cost accounting, operations, maintenance, etc.) to view data has greatly increased over the manual paper system. This also leaves the operating personnel more time to do work that keeps the Battery in design operating conditions, instead of spending hours doing laborious paperwork. The list of reports that are generated from the use of the automated system are:

1. Charging Report
2. Pushing Report

3. Oven Heating Report
4. Pushing Schedule Results Report
5. Coal/Moisture Quench Data Report
6. Emissions Databases (5 reports)
7. Charging/Pushing Summary Report
8. Process Parameters Report
9. Production Results/Month Report
10. Total Operations Delay Report All these reports would be either greatly reduced or not able to be reported without the automation of the Vectran Radio Frequency Data System.

Listed below is a sample of the data points that are captured and added to reports to enhance accuracy:

1. Push Time
2. Charge Time
3. Ram Amps/Ram Amps at Coke Face
4. Leveller Status
5. Jamb/Door Cleaner Operations
6. Charge Weight, Recorded Empty and Recorded Full Ecotrol—Battery Heating Model—Because the Ecotrol model gets some critical information from the Battery Machines, it is now more accurate than the original German designed model. The critical inputs into the model are:

1. Charge weight of coal into the ovens.
2. Coking time of all ovens.
3. Ability to recognize when ovens are in a "Delay Status," thus influencing heating of the Battery.
4. Having "Instantaneous" information for all ovens available for the "Model" to execute its heating calculations and to heat the Battery properly.

The "Model" is kept up-to-date without any "Manual" interaction. This is both efficient and accurate.

Specific Hardware and Software Data or Information

The Battery Data Communications system begins with the Quench Cars that have a pair of 'Full' duplex VR-20's modems for each Quench Car. The VR-20's are not unique and operate in the 450 to 460 MHZ band.

The rest of the system utilizes a pair of VR-30's Vectran modems per oven machine, excluding the U-Tube Car, which has no communications to the central system. The VR-30's however are unique and use the 'Spread Spectrum Technology' and operate in the 906 MHZ to 927 MHZ frequency band. Each unit has dual antennas that switch automatically depending on signal strength and the correct 'Spreading Code'. This dual antenna arrangement was requested by National Steel as a means or a work around reflected Radio Frequency waves or multi-pathing.

The Vectran VR-30 has a transmission rate adjustable up to 9600 BAUD. Because of this feature and the Half-Duplex transmission arrangement we can closely approach if not attain a throughput of 9600 bits per second.

The selection of the type of antennas to 'Gain-Yagi' also enhanced our system as these antennas are about +10 db to a true dipole with a directional pattern. Horizontal orientation was chosen to help with the problem of multi-pathing, which helps in the elimination of RF waves reflections. The 'Gain-Yagi' antennas were very good but came with a flaw. The anodized metal would corrode at the antenna frequency matching network. The corrosion would get so bad the antenna would cease to function. We then told Vectran that under the harsh environment of a Coke Oven Battery we would have to coat the antennas with some type of sealer or paint. Vectran promptly found an rubberized paint that had to be carefully applied as not to effect the gain of the antenna. The rubberized antennas were installed with little or no failures at the critical matching adjustment network.

After the installation of the spread spectrum modems and the 'High Gain Yagi' antennas we had to still overcome a certain amount of reflected waves or multi-pathing. We had to make a detailed on site mapping of the local radio conditions (mechanical interference's) to allow us to develop a plan for the best placement of the 'Gain-Yagi' antennas. These antennas had to be placed on the machines and on the land-based structures in a manner as to be in line of sight and not within a certain distance of any mechanical structures. In the same light we also had six machines and a total of seven (7) frequencies to choose and to allocate among six machines. Frequencies had to be carefully selected as to be a minimum of 3 MHZ apart and not in-line of sight with any of the other machines. Each set of antennas had to be installed in the opposite direction on each of the machines. It was necessary to mount the antennas for the west machines at the west end of the Battery. The set of antennas for the east machines were mounted at the east end of the Battery.

After all the above had been accomplished and many months of trial and error, strip charts and data taken, we found that within the Vectran unit there is a critical time-out adjustment that had to be properly set. This adjustment properly sets the RTS (Request to Send) and the CTS (Clear to Send). By adjusting this time-out, we were able to allow the radio modem to establish a "Solid Link" with the remote unit before allowing the GE Series 6 serial port to transfer or receive data.

This brought our successful communication rate to nearly 96%. It is very important that valid communications be as close to 100% as possible. If not, then it is possible that we can lose communications during one of our most critical operations, i.e., Leveling of an oven. This causes environmental problems and is not in our best interest.

As we further investigated the non-valid communications and the causes, I concluded that the antenna switching module and related wiring was located within the Vectran unit in a location in close proximity to the SSI board that handles the selection, transmission and determines valid spreading codes. This unit was re-located within the enclosure and the wiring routed away from the SSI board. With this last enhancement, we approach the 99.99% success rate that is required for uninterrupted communications. In the industry and utilizing this type of technology, this success rate is unheard of for real time communications using Radio Frequency generated data communications.

The Battery PLC has a task to monitor the successful communications and has a retry feature built into the software that allows three retry "Reads" and three retry "Writes" before a communication for the "Read" and "Write" not successful is logged on the Level II computer. The DCS also has certain diagnostics for each part of the system. Each Battery Machine also has a diagnostic alarm which, when triggered, suspends communications to the machine. Each machine has software coding that tells the machine when there is valid data. Data that is not valid is not processed by the machine. If valid data is not received in a prescribed length of time, the communications alarm is activated and the "Data OK" light extinguishes. The operator must clear the fault on the graphic screen and try to re-establish communications. If the communications cannot be re-established, then the machine must be changed and the problem diagnosed. Communications from the machines are still permitted as long as the ASCII basic module CRC is valid or the radio frequency modem has not failed.

In conclusion, we have no restriction on the transmission of data between the "Central" Battery PLC and the "remote" units. It is possible that all units can be either transmitting or receiving or a combination of both at the same time. The use of random transmissions is an extreme benefit and allows us to still further reduce reflected RF signals.

FUTURE ENHANCEMENTS TO THE BATTERY MACHINES VIA UTILIZATION OF THE RADIO FREQUENCY MODEM SYSTEM

1. Pushing Ram Amps—Transmit data from the Pusher Machine to the land-based PLC. This data will give the Ram position within the oven vs. the Ram Amps or Net pushing amps. A new Nematron screen will be added to show ram amps vs. ram position. This graph will also have limits as well as alarms that are also transmitted to the land base. The additional alarms will be:

Pushing Amps too high above 125% after coke face for a period of time set by a timer of adjustable length.

Pushing amps too high above 150% after coke face that will be an instantaneous value as determined by one scan of the Automax.

Percentage of current limit for the drive will be viewed as a red line on the screen with information sent to the land base as well as the "Bypass" signal sent to the land base.

The Ram Amps vs. am position graph will also be transmitted to the Level II computer so that oven Pushing histories can be logged and reviewed at any time.

EXTRACTING OVEN DOORS WITH CROSS BATTERY INTERLOCKING AUTOMATIC OPERATION

1. When the operator presses the automatic pushbutton "Extract Oven Door", the door extractor on the Door or Pusher Machine will start its sequence. At this time the CBI cylinder on either machine will be allowed to travel to its forward position.

2. When the CBI cylinder on the Pusher Machine reaches its forward position, a Vectran signal is sent to the Door Machine.

3. When the Vectran signal, 'CBI cylinder is forward' is received from the Pusher Machine and the 'CBI cylinder is forward' on the Door Machine, the CBI air solenoid is energized allowing air to flow in the piping to the Pusher Machine and activate the CBI air pressure switch, confirming the machines are at the same oven.

4. When the air pressure switch is activated on the Pusher Machine, another Vectran signal is sent to the Door Machine 'CBI Established'.

5. If all interlocks as stated above are correct and 'in sequence' the Pusher and Door Machine will continue to remove its doors. At the same as the doors are being removed the CBI air solenoid is de-energized on the Door Machine to conserve air pressure. Once the confirmation is made between the Pusher and Door Machines, the CBI signal is no longer necessary and will not be needed again until the 'Prepare to Push' sequence is started.

6. The Door Machine interlock 'Fans At Partial Speed' will remain as is and will 'Stop' the door from being removed if that interlock is not met.

7. If the proper signals are not received at the proper time, the Door Extractors will 'Stop' at the Door Extractor 'forward' position. At this time the operator will need to confirm with the operating foreman that a problem exists and 'Bypassing' of the interlocks is necessary. The Door Machine has one bypass screen, to 'Bypass' the 'CBI Established' signal from the Pusher Machine. This 'Bypass' is located on its own special screen and is similar to the CBI screen on the Pusher Machine. The Pusher Machine has one 'Bypass', which is located on a new screen almost identical to the screen used to bypass the 'CBI Air Interlock' to allow to 'Start Push' sequence to be enabled. This 'Bypass' allows the Pusher operator to bypass the 'CBI Air Interlock' signal and complete removing of the oven door.

8. Added to the 'Normal Bypass' screen on the Door Machine located in the first tow and labeled "I" for information is the signal sent from the Pusher Machine indicating that the 'CBI interlock cylinder is 'Forward'. The function of this signal is only to allow the operator to view the receipt of or not. Bypassing of this signal is not necessary. The new 'Bypass' screen as explained in Item 7 will be used to continue the removal of the 'Door' upon Vectran signal error.

9. An additional feature has been added to Door and Pusher Machine, added to the Vectran Bypass Screen called 'Door Maintenance Mode'. This mode is used when an 'Off line' machine needs to handle doors.

10. Door Maintenance Mode for the Door Machine—To be able to activate the 'DMM' the following conditions have to be met; 1) Data Transfer has to be in the 'Off' position, 2) Coke Guide has to be in the 'Retracted' position and 3) the CBI Interlock cylinder has to be in the 'Retracted' to position. When the 'DMM' has been activated the following equipment will be operational without having to use the normal 'Bypass Screen'; 1) Door Extractor, 2) Door Cleaner and 3) Jamb Cleaner. The Coke Guide, CBI Interlock cylinder and Date Transfer (Vectran) system will be disabled until the 'DMM' mode is released.

11. Door Maintenance Mode for the Pusher Machine—To be able to activate the 'DMM' the following conditions have to be met; 1) Data Transfer has to be in the 'Off' position, 2) Ram in the 'Retracted' position, 3) Leveller Bar in the 'Retracted' position, 4) Leveller Chute in the 'Retracted' position, and 5) Counter Thrust blocks 'Up'. When the 'DMM' has been activated the following equipment will be operational without having to use the normal 'Bypass Screen'; 1) Door Extractor, 2) Door Cleaner and 3) Jamb Cleaner. The Ram, Leveller Bar, Prepare to Push Cycle, Prepare for Levelling Cycle and Date Transfer (Vectran) system will be disabled until the 'DMM' mode is released.

12. Pusher Machine Start Push Revisions—Additional interlocking has been installed in the 'Start Push' auto sequence. The Door Machine will send a new Vectran signal 'DM Coke Guide Forward and Locked' to the pusher machine. This signal can be viewed and 'Bypassed' on the Normal Bypass screen and will utilize the function name "F3". This interlock was installed so that the Door Removal and Start Push functions would utilize correctly the air pressure signal from the Door Machine.

Fan At Full Speed Logic Revision

1. The PEC fans will not be allowed to go to 'Full Speed' unless the Quench Car is in position and has given the Pusher Machine the signal 'Ready For Push'. The Ram will operate as presently designed and will 'Stop' at the Coke face if the 'Fans' are not at 'Full Speed'. This change will limit the amount of time the 'Fan' is at 'Full Speed' without the Quench Car being 'In Position', providing additional energy savings and limit the amount of times the mechanical relief door operates at the est end of the PEC duct.

2. This change will be done within the Battery PLC.

Although specific constructions have been presented herein, it is to be understood that these are for illustrative purposes only. Various modifications and adaptations will be apparent to those of skill in the art. In view of possible modifications, it will be appreciated that the scope of the present invention should be determined by reference to the claims appended hereto.

What is claimed is:

1. A coke oven battery comprising:

a plurality of coke ovens;

a first set of machines associated with the plurality of coke ovens and having at least two machines selected from the group consisting of charging cars, pusher machines, and door machines;

a battery controller for controlling the first set of machines and the plurality of coke ovens;

a first set of radio land transceiver units operably connected to the battery controller, each land transceiver unit associated on a one-to-one basis with a corresponding one of the first set of machines; and a first set of radio machine transceiver units, each machine transceiver unit mounted for movement with a corresponding one of the first set of machines and operable to communicate with a corresponding land transceiver unit; and wherein each of the land transceiver units and each of the machine transceiver units are spread spectrum transceivers; and further comprising a first set of pairs of machine antennas, each pair operably connected to a corresponding one of the first set of machine transceiver units; a plurality of machine signal threshold detectors, one for each pair of the first set of pairs of machine antennas and operable to output a change signal when signal strength is inadequate; a plurality of machine switches, one for each pair of the first set of pairs of machine antennas and operable to switch one of the machine transceiver units from using one antenna to using another antenna upon receipt of a change signal; and wherein each machine transceiver unit has a pair of antennas selectively switchable thereto for use of one at a time.

2. The coke oven battery of claim 1 wherein the first set of machines includes at least one charging car, at least one pusher machine, and at least one door machine.

3. The coke oven battery of claim 1 wherein the first set of machines includes at least two charging cars, at least two pusher machines, and at least two door machines.

4. A coke oven battery comprising:

a plurality of coke ovens;

a first set of machines associated with the plurality of coke ovens and having at least two machines selected from the group consisting of charging cars, pusher machines, and door machines;

a battery controller for controlling the first set of machines and the plurality of coke ovens;

a first set of radio land transceiver units operably connected to the battery controller, each land transceiver unit associated on a one-to-one basis with a corresponding one of the first set of machines; and a first set of radio machine transceiver units, each machine transceiver unit mounted for movement with a corresponding one of the first set of machines and operable to communicate with a corresponding land transceiver unit; and wherein each of the land transceiver units and each of the machine transceiver units are spread spectrum transceivers and further comprising a first set of pairs of land antennas, each pair operably connected to a corresponding one of the first set of land transceiver units; a plurality of land signal threshold detectors, one for each pair of the first set of pairs of land antennas and operable to output a change signal when signal strength is inadequate; a plurality of land switches, one for each pair of the first set of pairs of land antennas and operable to switch one of the land transceiver units from using one antenna to using another antenna upon receipt of a change signal.

5. A coke oven battery comprising:

a plurality of coke ovens;

a first set of machines associated with the plurality of coke ovens and having at least two machines selected from the group consisting of charging cars, pusher machines, and door machines;

a battery controller for controlling the first set of machines and the plurality of coke ovens;

a first set of radio land transceiver units operably connected to the battery controller, each land transceiver unit associated on a one-to-one basis with a corresponding one of the first set of machines; and a first set of radio machine transceiver units, each machine transceiver unit mounted for movement with a corresponding one of the first set of machines and operable to communicate with a corresponding land transceiver unit; and wherein each of the land transceiver units and each of the machine transceiver units are spread spectrum transceivers and further comprising a first set of pairs of machine antennas, each pair operably connected to a corresponding one of the first set of machine transceiver units; a plurality of machine spread code threshold detectors, one for each pair of the first set of pairs of machine antennas and operable to output a change signal when a received spread code from a land transceiver unit is invalid; a plurality of machine switches, one for each pair of the first set of pairs of machine antennas and operable to switch one of the machine transceiver units from using one antenna to using another antenna upon receipt of a change signal; and wherein each machine transceiver unit has a pair of antennas selectively switchable thereto for use of one at a time.

6. The coke oven battery of claim 5 further comprising a first set of pairs of land antennas, each pair operably connected to a corresponding one of the first set of land transceiver units; a plurality of land spread code threshold detectors, one for each pair of the first set of pairs of land antennas and operable to output a change signal when a spread code received from one of the land transceiver units is invalid; a plurality of land switches, one for each pair of the first set of pairs of land antennas and operable to switch one of the land transceiver units from using one antenna to using another antenna upon receipt of a change signal.

7. The coke oven battery of claim 5 wherein each pair of machine antennas is coated with a rubber-based protective coating.

8. A coke oven battery comprising:

a plurality of coke ovens;

a first set of machines associated with the plurality of coke ovens and having at least two machines selected from the group consisting of charging cars, pusher machines, and door machines;

a battery controller for controlling the first set of machines and the plurality of coke ovens;

a first set of radio land transceiver units operably connected to the battery controller, each land transceiver unit associated on a one-to-one basis with a corresponding one of the first set of machines; and a first set of radio machine transceiver units, each machine transceiver unit mounted for movement with a corresponding one of the first set of machines and operable to communicate with a corresponding land transceiver unit; and wherein each of the land transceiver units and each of the machine transceiver units are spread spectrum transceivers and wherein said first set of machines includes a pusher and a door machine, and further comprising: means for an operator to input a pusher oven number corresponding to an oven number at which the pusher is disposed at; means to receive the pusher oven number; means for an operator to input a door machine oven number corresponding to an oven number at which the door machine is disposed at; means to receive the door machine oven number; means to compare the pusher oven number and the door machine oven number; and means to enable oven door removal upon the pusher oven number and the door machine oven number being equal ;and further comprising a first set of pairs of machine antennas, each pair operably connected to a corresponding one of the first set of machine transceiver units; a plurality of machine spread code threshold detectors, one for each pair of the first set of pairs of machine antennas and operable to output a change signal when a received spread code from a land transceiver unit is invalid; a plurality of machine switches, one for each pair of the first set of pairs of machine antennas and operable to switch one of the machine transceiver units from using one antenna to using another antenna upon receipt of a change signal; and wherein each machine transceiver unit has a pair of antennas selectively switchable thereto for use of one at a time.

9. A coke oven battery comprising:

a plurality of coke ovens;

a first set of machines associated with the plurality of coke ovens and having at least two machines selected from the group consisting of charging cars, pusher machines, and door machines;

a battery controller for controlling the first set of machines and the plurality of coke ovens;

a first set of radio land transceiver units operably connected to the battery controller, each land transceiver unit associated on a one-to-one basis with a corresponding one of the first set of machines; and a first set of radio machine transceiver units, each machine transceiver unit mounted for movement with a corresponding one of the first set of machines and operable to communicate with a corresponding land transceiver unit; and wherein each of the land transceiver units and each of the machine transceiver units are spread spectrum transceivers and wherein said first set of machines includes a charge car and a pusher having a leveler offset from a main part thereof, and further comprising: means for an operator to input a charge oven number corresponding to an oven number at which charging is desired; means to receive the charge oven number; means for an operator to input a pusher oven number corresponding to an oven number at which the pusher is disposed at; means to receive the pusher oven number; and means to prevent charging unless the charging oven number and pusher oven number have a difference corresponding to an offset between a leveler and compare the pusher oven number and the door machine oven number; and further comprising a first set of pairs of land antennas, each pair operably connect to a corresponding one of the first set of land transceiver units; a plurality of land spread code threshold detectors, one for each pair of the first set of pairs of land antennas and operable to output a change signal when a spread code received from one of the land transceiver units is invalid; a plurality of land switches, one for each pair of the first set of pairs of land antennas and operable to switch one of the land transceiver units from using one antenna to using another antenna upon receipt of a change signal.

10. A coke oven battery comprising:

a plurality of coke ovens;

a first set of machines associated with the plurality of coke ovens and having at least two machines selected from the group consisting of charging cars, pusher machines, and door machines;

a battery controller for controlling the first set of machines and the plurality of coke ovens;

a first set of radio land transceiver units operably connected to the battery controller, each land transceiver unit associated on a one-to-one basis with a corresponding one of the first set of machines; and a first set of radio machine transceiver units, each machine transceiver unit mounted for movement with a corresponding one of the first set of machines and operable to communicate with a corresponding land transceiver unit; and wherein each of the land transceiver units and each of the machine transceiver units are spread spectrum transceivers and wherein the battery controller is operable to cause each land transceiver unit to send a given communication to the corresponding machine transceiver unit, test for successful transmission, resend the given communication n times if transmission is not yet successful, initiate a read of machine data if transmission is unsuccessful within n attempts, test for successful read, try reading again m times if reading is not yet successful again, and initiate an alarm condition if reading is unsuccessful after m attempts; and wherein communication between the land transceiver units and the machine transceiver units is at least 99% reliable.

11. A coke oven battery comprising:

a plurality of coke ovens;

a first set of machines associated with the plurality of coke ovens and having at least two machines selected from the group consisting of charging cars, pusher machines, and door machines;

a battery controller for controlling the first set of machines and the plurality of coke ovens;

a first set of radio land transceiver units operably connected to the battery controller, each land transceiver unit associated on a one-to-one basis with a corresponding one of the first set of machines; and a first set of radio machine transceiver units, each machine transceiver unit mounted for movement with a corresponding one of the first set of machines and operable to communicate with a corresponding land transceiver unit; and further comprising a first set of pairs of machine antennas, each pair operably connected to a corresponding one of the first set of machine transceiver units; a plurality of machine signal threshold detectors, one for each pair of the first set of pairs of machine antennas and operable to output a change signal when signal strength is inadequate; a plurality of machine switches, one for each pair of the first set of pairs of machine antennas and operable to switch one of the machine transceiver units from using one antenna to using another antenna upon receipt of a change signal; and wherein each machine transceiver unit has a pair of antennas selectively switchable thereto for use of one at a time.

12. The coke oven battery of claim 11 further comprising a first set of pairs of land antennas, each pair operably connected to a corresponding one of the first set of land transceiver units; a plurality of land signal threshold detectors, one for each pair of the first set of pairs of land antennas and operable to output a change signal when signal strength is inadequate; a plurality of land switches, one for each pair of the first set of pairs of land antennas and operable to switch one of the land transceiver units from using one antenna to using another antenna upon receipt of a change signal.

13. The coke oven battery of claim 11 wherein communication between the land transceiver units and the machine transceiver units is at least 99% reliable.

14. The coke oven battery of claim 11 wherein the coke oven battery has first and second ends, and wherein the first set of machines includes a first charging car, a first pusher machine, and a first door machine associated with the first end and includes second charging car, a second pusher machine, and a second door machine associated with the second end; and wherein land antennas associated with the first charging car, the first pusher machine, and the first door machine are at the first end and wherein land antennas associated with the second charging car, the second pusher machine, and the second door machine are at the second end.

15. The coke oven battery of claim 11 wherein each of the land transceiver units and each of the machine transceiver units are spread spectrum transceivers, and further comprising a plurality of machine spread code threshold detectors, one for each pair of the first set of pairs of machine antennas and operable to output a change signal when a received spread code from a land transceiver unit is invalid.

16. The coke oven battery of claim 15 wherein communication between the land transceiver units and the machine transceiver units is at least 99% reliable.

17. A coke oven battery comprising:

a plurality of coke ovens;

a first set of machines associated with the plurality of coke ovens and having at least two machines selected from the group consisting of charging cars, pusher machines, and door machines;

a battery controller for controlling the first set of machines and the plurality of coke ovens;

a first set of radio land transceiver units operably connected to the battery controller, each land transceiver unit associated on a one-to-one basis with a corresponding one of the first set of machines; and a first set of radio machine transceiver units, =each machine transceiver unit mounted for movement with a corresponding one of the first set of machines and operable to communicate with a corresponding land transceiver unit; and wherein the battery controller is operable to cause each land transceiver unit to send a given communication to the corresponding machine transceiver unit, test for successful transmission, resend the given communication n times if transmission is not yet successful, initiate a read of machine data if transmission is unsuccessful within n attempts, test for successful read, and try reading again m times if reading is not yet successful again.

18. The coke oven battery of claim 17 where n equals 3 and m equals 3.

19. The coke oven battery of claim 17 further comprising a first set of pairs of machine antennas, each pair operably connected to a corresponding one of the first set of machine transceiver units; a plurality of machine signal threshold detectors, one for each pair of the first set of pairs of machine antennas and operable to output a change signal when signal strength is inadequate; a plurality of machine switches, one for each pair of the first set of pairs of machine antennas and operable to switch one of the machine transceiver units from using one antenna to using another antenna upon receipt of a change signal; and wherein each machine transceiver unit has a pair of antennas selectively switchable thereto for use of one at a time.

20. The coke oven battery of claim 17 further comprising a first set of pairs of machine antennas, each pair operably connected to a corresponding one of the first set of machine transceiver units; a plurality of machine spread code threshold detectors, one for each pair of the first set of pairs of machine antennas and operable to output a change signal when a received spread code from a land transceiver unit is invalid; a plurality of machine switches, one for each pair of the first set of pairs of machine antennas and operable to switch one of the machine transceiver units from using one antenna to using another antenna upon receipt of a change signal; and wherein each machine transceiver unit has a pair of antennas selectively switchable thereto for use of one at a time.

* * * * *

UNITED STATES PATENT AND TRADEMARK OFFICE

CERTIFICATE OF CORRECTION

PATENT NO. : 5,600,564

DATED : February 4, 1997

INVENTOR(S) : James J. TARASIEWICZ; Edward C. NICHOLS

It is certified that error appears in the above-indentified patent and that said Letters Patent is hereby corrected as shown below:

In Claim 9, column 30, line 6, change "connect" to -- connected --;

In Claim 17, column 32, line 7, change "=each" to -- each --.

Signed and Sealed this

Twenty-ninth Day of April, 1997

Bruce Lehman

*Attest:*

BRUCE LEHMAN

*Attesting Officer*

*Commissioner of Patents and Trademarks*